US009468327B2

(12) United States Patent
Shi

(10) Patent No.: US 9,468,327 B2
(45) Date of Patent: Oct. 18, 2016

(54) METHOD AND SYSTEM FOR DISPENSING SHOE COVERS

(71) Applicant: Zhen Shi, Leisure Town Hangzhou (CN)

(72) Inventor: Zhen Shi, Leisure Town Hangzhou (CN)

( * ) Notice: Subject to any disclaimer, the term of this patent is extended or adjusted under 35 U.S.C. 154(b) by 96 days.

(21) Appl. No.: 14/365,680

(22) PCT Filed: Dec. 12, 2012

(86) PCT No.: PCT/CN2012/086386
§ 371 (c)(1),
(2) Date: Jun. 16, 2014

(87) PCT Pub. No.: WO2013/086970
PCT Pub. Date: Jun. 20, 2013

(65) Prior Publication Data

US 2014/0353326 A1 Dec. 4, 2014

(30) Foreign Application Priority Data

Dec. 17, 2011 (CN) ..... 2011 1 0425963

(51) Int. Cl.
*A47G 25/90* (2006.01)

(52) U.S. Cl.
CPC ..... *A47G 25/907* (2013.01)

(58) Field of Classification Search
CPC ..... A43B 3/16
See application file for complete search history.

(56) References Cited

U.S. PATENT DOCUMENTS 7,448,521 B2 * 11/2008 Hu ..... A43B 3/163 12/1 R
2006/0144879 A1 7/2006 Hu

FOREIGN PATENT DOCUMENTS

| | | | |
|---|---|---|---|
| CN | 2538176 | Y | 3/2003 |
| CN | 2626864 | Y | 7/2004 |
| CN | 2634974 | Y | 8/2004 |
| CN | 2664521 | Y | 12/2004 |
| CN | 201135228 | Y | 10/2008 |
| CN | 101797115 | A | 8/2010 |
| CN | 202365561 | U | 8/2012 |
| CN | 202408355 | U | 9/2012 |
| CN | 102715819 | A | 10/2012 |
| CN | 202477303 | U | 10/2012 |
| JP | 2006-94990 | A | 4/2006 |

* cited by examiner

*Primary Examiner* — Gene Crawford
*Assistant Examiner* — Ayodeji Ojofeitimi
(74) *Attorney, Agent, or Firm* — Birch, Stewart, Kolasch & Birch, LLP

(57) ABSTRACT

A method and a system for dispensing shoe covers are disclosed. The shoe cover dispensing method comprises the following steps: propping a shoe cover open; inverting; determining if relay has been reset and if not then repeating the determining; opening; relaying; waiting for use; completing usage; resetting the relay; determining if the inverting has been completed and if not then repeating the determining; jumping to the opening step. The shoe cover dispensing system comprises a shoe cover storage module (100), an extracting module (200), an opening module (300), and a relay module (400). Compared with the prior art, the method and system for dispensing shoe covers of the present invention are convenient for pre-storing shoe covers with more pre-stored shoe covers contained at one time, the pre-storing is convenient, the accuracy requirements for pre-storing the shoe covers are low, the occupied space is saved, and the operating efficiency is high.

19 Claims, 11 Drawing Sheets

METHOD AND SYSTEM FOR DISPENSING SHOE COVERS

TECHNICAL FIELD

The present invention relates to a method and a system for dispensing shoe covers.

BACKGROUND OF THE INVENTION

Not only in private houses, but also in industrial and commercial venues, guests often needs to enter with shoe covers on their shoes, which is both hygienic and convenient. Thus, shoe cover dispensing machines appear on the market, and inventors have been trying to explore means to solve the problem of how to dispensing shoe covers rapidly and reliably.

The Chinese patent literature CN2538176 disclosed on Mar. 5, 2003 a shoe cover dispensing machine for solving the problems of inconvenience and bacterial infection of feet which are caused by required shoe-changing when entering certain venues. The machine comprises a main body, standing poles, a footplate, a pushing and releasing mechanism, and etc., forming an automatic device for covering shoe covers onto shoes. This device coordinates with shoe covers to allow a user to place his shoe into this device by simply lifting his foot when he needs to enter the room, so as to allow a disposable soft shoe cover to cover onto the outside of his shoe by associated functioning of various components. Thereby the inconvenience and bacterial cross-infection of feet caused by shoe-changing when entering the room are eliminated, and it also appears to be civilized and elegant. A hole is provided on the machine shell for placing a shoe therein, and a footplate, a shoe cover ouch fixing rod and a shoe cover ouch pushing and releasing mechanism are provided in the machine main body; a spring is jacketed outside the shoe cover ouch fixing rod, and a push ring is provided above the spring; the footplate can move upwards and downwards along its fixing pole; one end of a poking and forking element is connected to the footplate, and the other end is capable of pushing a push block on a movable push plate; the movable push plate is connected to a supporting plate through a rotating shaft, and the supporting plate is provided with a slot allowing the push block on the movable push plate to move therein; a shoe cover ouch baffle is provided above the shoe cover ouch fixing rod, each shoe cover has an elastic mouth, and shoe cover ouches are provided on the mouth. This shoe cover dispensing machine is capable of operating automatically, and is very convenient to use.

However, the deficiencies of the aforementioned patent technology are also obvious, i.e., it is very inconvenient to replace the back-up shoe covers. To solve this problem, the Chinese patent literature CN2626864 disclosed on Jul. 21, 2004 a shoe cover dispensing machine. A hole is provided on the machine shell for placing a shoe therein, and a footplate, a shoe cover ouch fixing rod and a shoe cover ouch pushing and releasing mechanism are provided in the machine main body; a spring is jacketed outside the shoe cover ouch fixing rod, and a push ring is provided above the spring; the footplate can move upwards and downwards along its fixing pole. One end of a poking and forking element is connected to the footplate, and the other end is capable of pushing a push block on a movable push plate; the movable push plate is connected to a supporting plate through a rotating shaft, and the supporting plate is provided with a slot allowing the push block on the movable push plate to move therein; a shoe cover ouch baffle is provided above the shoe cover ouch fixing rod, each shoe cover has an elastic mouth, and shoe cover ouches are provided on the mouth. This shoe cover dispensing machine is characterized in its simple structure and convenient use.

In the aforementioned second patent technology, when replacing with new shoe covers, the pressing plate is pushed downward and fixed with hooks, which makes the replacing of shoe covers become convenient to a certain extent, but the problem is not solved completely, because of the fact that when pre-storing shoe covers, the shoe covers need to be propped open one by one, and mounted onto the fixing rod one by one. These types of technologies are not only inconvenient to replace (pre-store) shoe covers, but also have the problems of less amount of pre-stored shoe covers, lack of operating reliability, and etc.

SUMMARY OF THE INVENTION

One objective of the present invention is to provide a shoe cover dispensing method and a shoe cover dispensing system which are convenient to pre-store shoe covers, so as to overcome the deficiencies of the aforementioned prior arts.

A second objective of the present invention is to provide a shoe cover dispensing method and a shoe cover dispensing system which can pre-store large amount of shoe covers at one time (large amount of one-time storage), so as to overcome the deficiencies of the aforementioned prior arts.

A third objective of the present invention is to provide a shoe cover dispensing method and a shoe cover dispensing system with high operating reliability, so as to overcome the deficiencies of the aforementioned prior arts.

A fourth objective of the present invention is to provide a shoe cover dispensing method and a shoe cover dispensing system with low requirements of accuracy for pre-storing the shoe covers.

A fifth objective of the present invention is to provide a shoe cover dispensing method and a shoe cover dispensing system with high operating efficiency.

A sixth objective of the present invention is to provide a shoe cover dispensing method and a shoe cover dispensing system which can save the occupied space.

These objectives of the present invention are achieved by providing a shoe cover dispensing method, comprising a shoe cover storage module, an extracting module, an opening module and a relay module, wherein, the method comprises the following steps: S1: propping a shoe cover open; S2: inverting; S3: determining if the relay has been reset, and if not then repeating step S3; S4: opening; S5: relaying; S6: waiting for use; S7: completing usage; S8: resetting the relay; S9: determining if the inverting has been completed, and if not then repeating step S9; S10: jumping to step S4; wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; and, propping of step S1 refers to propping the elastic mouth of each shoe cover open inside the elongated opening by the claws of the extracting module; inverting of step S2 refers to extracting the shoe cover out of the storage module by the claws of the extracting module through inverting motion; determining of step S3 refers to determining if the relay has been reset, and if the relay has not been reset, then repeating step S3, and if the relay has been reset then jumping to the next step; opening of step S4 refers to hooking the elastic mouth of the shoe cover by the drag hooks of the opening module and by the drag hooks of the opening module and moving the drag hooks relative to the claws, thus opening the elastic mouth of the shoe cover; relaying of step S5 refers to unfolding the relay poles of the relay module and receiving the shoe cover from the claws by the relay poles, thus allowing the relay poles to keep the elastic mouth of the shoe cover in propped state instead of the claws in conjunction with the drag hooks, when the claws are inverted back to the elongated opening and the next step S1 of propping are started; resetting the relay of step S8 refers to folding the relay poles to a status the same as that before the relaying step; determining of step S9 refers to determining if the inverting has been completed, and if it has not been completed then repeating step S9, and if the inverting has been completed then jumping to step S4 so as to enter the next loop.

The aforementioned shoe cover dispensing method, wherein, the elongating direction of the shoe cover is consistent with the elongating direction of the elongated opening, and movement of the claws for propping the elastic mouth open is a rectilinear motion in the elongating direction of the elongated opening. The effect of the rectilinear motion is that the claws may prop open from a very short distance away to a very long distance away inside the elastic mouth, so that the requirements of accuracy for pre-storing the shoe covers are low, which lowers the cost of pre-storing.

The aforementioned shoe cover dispensing method, wherein, the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively. The effect of performing this rectilinear motion by means of screws is that the movement is reliable, the control is simple, and driving force can be provided for the inversion of the claws.

The aforementioned shoe cover dispensing method, wherein, the drag hook is provided with a U-shaped notch, and at the beginning of the opening step, two ends of the notch of the drag hook pass by two sides of the claw when the elastic mouth of the shoe cover is hooked by one end of the notch of the drag hook; or the drag hook is L-shaped, and at the beginning of the opening step, one end of the L-shaped drag hook passes by an inner side of the claw and hooks the elastic mouth of the shoe cover. The effect of the U-shaped drag hook is that the opening of the shoe cover can be completed during the movement of the U-shaped drag hook. The effect of the U-shaped drag hook is also that the length of the drag hook is reduced, so as to save the occupied space of the mechanism for opening. A solution which may replace the U-shaped drag hook is that the drag hook is L-shaped, and at the beginning of the opening step, one end of the L-shaped drag hook passes by the inner side of the claw and hooks the elastic mouth of the shoe cover. The U-shape and L-shape mentioned in the present invention refer to the shape of the drag hook on the plane perpendicular to its moving direction, which can be the cross-sectional shape of the drag hook, the projection shape of the drag hook or the shape of the movement track of the drag hook.

The aforementioned shoe cover dispensing method, wherein, two sets of drag hooks are provided and adapted for operating alternately, when one set of drag hooks complete the opening step, the other set of drag hooks are reset and prepared for receiving the next shoe cover, so as to save the time for returning the drag hooks.

The aforementioned shoe cover dispensing method, wherein, a pair of the relay poles with free ends are provided, during the relaying step the free ends of the relay poles swing downward or extend downward, and during the relay resetting step the free ends of the relay poles swing upward or retract upward. By adopting the swinging-out/swinging-back mode, or the extending/retracting mode, the relay poles can avoid (the front ends in the opening direction of) the shoe cover when the drag hooks open the shoe cover, and then, by swinging out or extending, the relay poles can receive (the rear ends in the opening direction of) the shoe cover.

The aforementioned shoe cover dispensing method, wherein, a chamfer for relaying or an arc for relaying is provided on a backside of each of the claws.

The aforementioned shoe cover dispensing method, wherein, the shoe covers are arranged in flat state and in stacked manner in the shoe cover storage module. By adopting the laminated stacking mode, the cost of pre-storing is lowered.

The aforementioned shoe cover dispensing method, wherein, the shoe cover is opened in width direction thereof. By opening in the width direction, the stroke of opening is short, the time of opening is saved, and the occupied space of the mechanism for opening is saved. Accordingly, the stroke along the propping-open direction of the shoe cover is long, so that the claws have a relatively long propping-open distance, and the requirements of accuracy for placing the shoe covers are low.

The aforementioned shoe cover dispensing method, wherein, the elongating direction of the shoe cover is consistent with the elongating direction of the elongated opening, and movement of the claws for propping the elastic mouth open is a rectilinear motion in the elongating direction of the elongated opening; the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively; the drag hook is provided with a U-shaped notch, and at the beginning of the opening step, two ends of the notch of the drag hook pass by two sides of the claw when the elastic mouth of the shoe cover is hooked by one end of the notch of the drag hook; two sets of drag hooks are provided and adapted for operating alternately, when one set of drag hooks complete the opening step, the other set of drag hooks are reset and prepared for receiving the next shoe cover, so as to save the time for returning the drag hooks; a pair of the relay poles with free ends are provided, during the relaying step the free ends of the relay poles swing downward or extend downward, and during the relay resetting step the free ends of the relay poles swing upward or retract upward; a chamfer for relaying or an arc for relaying is provided on a backside of each of the claws; the shoe covers are arranged in flat state and in stacked manner in the shoe cover storage module; the shoe cover is opened in width direction thereof. A solution which may replace the U-shaped drag hook is that the drag hook is L-shaped, and at the beginning of the opening step, one end of the L-shaped drag hook passes by the inner side of the claw and hooks the elastic mouth of the shoe cover.

The objectives of the present invention are also achieved by providing a shoe cover dispensing method, comprising a shoe cover storage module, an extracting module, an opening module and a relay module, wherein, the method comprises the following steps: S1: propping a shoe cover open; S2: inverting; S3: determining if the usage has been completed, and if not then repeating step S3; S4: opening; S5: resetting the relay; S6: relaying; S7: waiting for use; S8: completing usage; S9: determining if the inverting has been completed, and if not then repeating step S9; S10: jumping to step S4; wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; and, propping of step S1 refers to propping the elastic mouth of each shoe cover open inside the elongated opening by the claws of the extracting module; inverting of step S2 refers to extracting the shoe cover out of the storage module by the claws of the extracting module through inverting motion; determining of step S3 refers to determining if the usage has been completed, and if not then repeating step S3, and if the usage has been completed then jumping to the next step; opening of step S4 refers to hooking the elastic mouth of the shoe cover by the drag hooks of the opening module and by the drag hooks of the opening module and moving the drag hooks relative to the claws, thus opening the elastic mouth of the shoe cover; resetting the relay of step S5 refers to folding the relay poles before the drag hooks pass a relaying position at which the unfolded relay poles stay; relaying of step S6 refers to unfolding the relay poles of the relay module and receiving the shoe cover from the claws by the relay poles, thus allowing the relay poles to keep the elastic mouth of the shoe cover in propped state instead of the claws in conjunction with the drag hooks, when the claws are inverted back to the elongated opening and the next step S1 of propping are started; determining of step S9 refers to determining if the inverting has been completed, and if it has not been completed then repeating step S9, and if the inverting has been completed then jumping to step S4 so as to enter the next loop. In this solution, the relay resetting is set after the opening step, because after the opening step starts, the drag hooks and the front ends (in the opening direction) of the shoe cover do not immediately pass the position at which the relay poles are, therefore, this solution utilizes the time period before the drag hooks pass the position at which the relay poles are to complete the relay resetting.

The aforementioned shoe cover dispensing method, wherein, the elongating direction of the shoe cover is consistent with the elongating direction of the elongated opening, and movement of the claws for propping the elastic mouth open is a rectilinear motion in the elongating direction of the elongated opening; the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively; the drag hook is provided with a U-shaped notch, and at the beginning of the opening step, two ends of the notch of the drag hook pass by two sides of the claw when the elastic mouth of the shoe cover is hooked by one end of the notch of the drag hook; or the drag hook is L-shaped, and at the beginning of the opening step, one end of the L-shaped drag hook passes by an inner side of the claw and hooks the elastic mouth of the shoe cover; two sets of drag hooks are provided and adapted for operating alternately, when one set of drag hooks complete the opening step, the other set of drag hooks are reset and prepared for receiving the next shoe cover, so as to save the time for returning the drag hooks; a pair of the relay poles with free ends are provided, during the relaying step the free ends of the relay poles swing downward or extend downward, and during the relay resetting step the free ends of the relay poles swing upward or retract upward; a chamfer for relaying is provided on a backside of each of the claws; the shoe covers are arranged in flat state and in stacked manner in the shoe cover storage module; the shoe cover is opened in width direction thereof.

The objectives of the present invention are also achieved by providing a shoe cover dispensing method, comprising a shoe cover storage module, an extracting module, an opening module and a relay module, wherein, the method comprises the following steps: S1: propping a shoe cover open; S2: determining if the usage has been completed, and if not then repeating step S2; S3: inverting; S4: opening; S5: relaying; S6: waiting for use; S7: completing usage; S8: determining if the inverting has been completed, and if not then repeating step S8; S9: jumping to step S4; wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; the position of the claw at step S5 aligns with the relay pole in the opening direction of the shoe cover; and, propping of step S1 refers to propping the elastic mouth of each shoe cover open inside the elongated opening by the claws of the extracting module; inverting of step S3 refers to delivering the shoe cover to a relay position by the claws of the extracting module through inverting motion, and allowing the elastic mouth of the shoe cover to encompass the relay poles; opening of step S4 refers to hooking the elastic mouth of the shoe cover by the drag hooks of the opening module and by the drag hooks of the opening module and moving the drag hooks relative to the claws, thus opening the elastic mouth of the shoe cover; relaying of step S5 refers to acting a dragging force on the elastic mouth of the shoe cover by the drag hooks, allowing the elastic mouth of the shoe cover to detach from the claws and slip to the relay poles, thus allowing the relay poles to keep the elastic mouth of the shoe cover in propped state instead of the claws in conjunction with the drag hooks, when the claws are inverted back to the elongated opening and the next step S1 of propping are started; determining of S8 refers to determining if the inverting has been completed, and if it has not been completed then repeating step S8, and if the inverting has been completed then jumping to step S4 so as to enter the next loop.

The aforementioned shoe cover dispensing method, wherein, during the relaying step S5, the dragging force of the drag hooks is acted on the elastic mouth of the shoe cover, and meanwhile the claws move towards the middle, so as to cause the elastic mouth of the shoe cover to detach from the claws and slip to the relay poles.

The aforementioned shoe cover dispensing method, wherein, the relay poles are able to be unfolded and folded.

The aforementioned shoe cover dispensing method, wherein, the relay poles are set stationary, and each relay pole is provided with a step structure adapted for avoiding a collision with the claw.

The aforementioned shoe cover dispensing method, wherein, the elongating direction of the shoe cover is consistent with the elongating direction of the elongated opening, and movement of the claws for propping the elastic mouth open is a rectilinear motion in the elongating direction of the elongated opening.

The aforementioned shoe cover dispensing method, wherein, the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively.

The aforementioned shoe cover dispensing method, wherein, the drag hook is provided with a U-shaped notch, and at the beginning of the opening step, two ends of the notch of the drag hook pass by two sides of the claw when the elastic mouth of the shoe cover is hooked by one end of the notch of the drag hook; or the drag hook is L-shaped, and at the beginning of the opening step, one end of the L-shaped drag hook passes by an inner side of the claw and hooks the elastic mouth of the shoe cover.

The aforementioned shoe cover dispensing method, wherein, two sets of drag hooks are provided and adapted for operating alternately, when one set of drag hooks complete the opening step, the other set of drag hooks are reset and prepared for receiving the next shoe cover, so as to save the time for returning the drag hooks.

The objectives of the present invention are also achieved by providing a shoe cover dispensing method, comprising a shoe cover storage module, an extracting module, an opening module and a relay module, wherein, the method comprises the following steps: S1: propping a shoe cover open; S2: inverting; S3: determining if the usage has been completed, and if not then repeating step S3; S4: opening; S5: relaying; S6: waiting for use; S7: completing usage; S8: determining if the inverting has been completed, and if not then repeating step S8; S9: jumping to step S4; wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; the relay poles are set stationary, and in the opening direction of the shoe cover, the position of the relay pole is more forward than the position of the claw at step S5, and the drag hooks pass by below the bottom of the relay poles when performing step S4; and, propping of step S1 refers to propping the elastic mouth of each shoe cover open inside the elongated opening by the claws of the extracting module; inverting of step S2 refers to extracting the shoe cover out of the storage module by the claws of the extracting module through inverting motion; opening of step S4 refers to hooking the elastic mouth of the shoe cover by the drag hooks of the opening module and by the drag hooks of the opening module and moving the drag hooks relative to the claws, thus opening the elastic mouth of the shoe cover; relaying of step S5 refers to hanging the shoe cover onto the relay poles of the relay module by the claws and then inverting the claws back, thus allowing the relay poles to keep the elastic mouth of the shoe cover in propped state instead of the claws in conjunction with the drag hooks, and the next step S1 of propping are started when the claws are inverted back to the elongated opening; determining of step S8 refers to determining if the inverting has been completed, and if it has not been completed then repeating step S8, and if the inverting has been completed then jumping to step S4 so as to enter the next loop.

The aforementioned shoe cover dispensing method, wherein, relaying of step S5 is performed after the drag hooks pass by below the bottom of the relay poles in the opening step S4.

The aforementioned shoe cover dispensing method, wherein, relaying of step S5 is started before the completion of step S4, and step S6 is performed after the completion of both step S4 and step S5.

The aforementioned shoe cover dispensing method, wherein, the elongating direction of the shoe cover is consistent with the elongating direction of the elongated opening, and movement of the claws for propping the elastic mouth open is a rectilinear motion in the elongating direction of the elongated opening.

The aforementioned shoe cover dispensing method, wherein, the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively.

The aforementioned shoe cover dispensing method, wherein, the drag hook is provided with a U-shaped notch, and at the beginning of the opening step, two ends of the notch of the drag hook pass by two sides of the claw when the elastic mouth of the shoe cover is hooked by one end of the notch of the drag hook; or the drag hook is L-shaped, and at the beginning of the opening step, one end of the L-shaped drag hook passes by an inner side of the claw and hooks the elastic mouth of the shoe cover.

The aforementioned shoe cover dispensing method, wherein, two sets of drag hooks are provided and adapted for operating alternately, when one set of drag hooks complete the opening step, the other set of drag hooks are reset and prepared for receiving the next shoe cover, so as to save the time for returning the drag hooks.

The objectives of the present invention are also achieved by providing a shoe cover dispensing method, comprising a shoe cover storage module, an extracting module, an opening module and a relay module, wherein: the extracting module performs the following steps: SA1 propping a shoe cover open, referring to propping the shoe cover open inside the storage module by claws; SA2 inverting, referring to inverting the propped shoe cover to an opening/relay position; the opening module performs the following steps: SB1 opening, referring to opening the shoe cover by drag hooks; SB2 waiting for use, and using the shoe cover; the extracting module and the relay module together perform the following step: SC1 relaying, referring to hanging the back ends of the shoe cover onto the relay poles by the claws of the extracting module, and then inverting the claws back; the circulating operation of steps SB1 and SB2 and the circulating operation of steps SA1 and SA2 are performed simultaneously.

The aforementioned shoe cover dispensing method, wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws.

The aforementioned shoe cover dispensing method, wherein, the elongating direction of the shoe cover is consistent with the elongating direction of the elongated opening, and movement of the claws for propping the elastic mouth open is a rectilinear motion in the elongating direction of the elongated opening.

The aforementioned shoe cover dispensing method, wherein, the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively.

The aforementioned shoe cover dispensing method, wherein, the drag hook is provided with a U-shaped notch, and at the beginning of the opening step, two ends of the notch of the drag hook pass by two sides of the claw when the elastic mouth of the shoe cover is hooked by one end of the notch of the drag hook; or the drag hook is L-shaped, and at the beginning of the opening step, one end of the L-shaped drag hook passes by an inner side of the claw and hooks the elastic mouth of the shoe cover.

The aforementioned shoe cover dispensing method, wherein, two sets of drag hooks are provided and adapted for operating alternately, when one set of drag hooks complete the opening step, the other set of drag hooks are reset and prepared for receiving the next shoe cover, so as to save the time for returning the drag hooks.

The objectives of the present invention are also achieved by providing a shoe cover dispensing system, comprising a shoe cover storage module, an extracting module, an opening module and a relay module, wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws.

The aforementioned shoe cover dispensing system, wherein, the shoe cover storage module is arranged on top of the extracting module, with the elongated opening oriented downwards, the opening module is arranged below the extracting module, with the shoe cover receiving end of the opening module arranged close to the extracting module, and the relay module is arranged close to the shoe cover receiving end of the opening module.

The aforementioned shoe cover dispensing system, wherein, the extracting module comprises a reverse-flighted screw rod and a pair of nuts with screw-threads of inverse directions, a pair of the claws are fixedly connected on a pair of the nuts, respectively, or the claws are integrated with the nuts to form a whole piece respectively; and the extracting module further comprises a guiding unit adapted for constraining the rotation of the claws.

The aforementioned shoe cover dispensing system, wherein, the guiding unit comprises a locating frame provided with a locating slot along the elongating direction of the reverse-flighted screw rod, and the claws are constrained within the locating slot of the locating frame; or, the guiding unit comprises a locating shaft provided along the elongating direction of the reverse-flighted screw rod, the claws have guiding apertures corresponding to the locating shaft, and the claws are sleeved onto the locating shaft through the guiding apertures.

The aforementioned shoe cover dispensing system, wherein, the extracting module further comprises a locating device for fastening the guiding unit.

The aforementioned shoe cover dispensing system, wherein, the extracting module further comprises an oscillating arm connected to the guiding unit, and a decelerating mechanism through which the guiding unit is connected in mechanical linkage with the screw rod.

The aforementioned shoe cover dispensing system, wherein, the oscillating arm is connected to the guiding unit through a clutch mechanism.

The aforementioned shoe cover dispensing system, wherein, the decelerating mechanism is a gear mechanism comprising an input gear fixed on the reverse-flighted screw rod, a dual gear engaged with the input gear, an output gear engaged with the dual gear, and an oscillating arm fixedly connected on the output gear; or, the decelerating mechanism is a synchronous belt decelerating mechanism.

The aforementioned shoe cover dispensing system, wherein, the clutch mechanism comprises an arc-shaped slot provided on the oscillating arm and a pin provided inside the arc-shaped slot, the pin is fixedly connected on the locating frame; or, the clutch mechanism comprises an arc-shaped slot provided on the locating frame and a pin provided inside the arc-shaped slot, the pin is fixedly connected on the oscillating arm.

The aforementioned shoe cover dispensing system, wherein, the extracting module comprises a shell, the locating device is fixedly connected on the shell, the locating device has locating status and disengaged status; when the oscillating arm and the guiding unit are disengaged through the clutch mechanism, the locating device is at the locating status; when the oscillating arm and the guiding unit are engaged through the clutch mechanism, the locating device is at the disengaged status.

The aforementioned shoe cover dispensing system, wherein, the locating device comprises a magnet provided on the locating device or on the guiding unit, and attraction force is formed between the locating device and the guiding unit.

The aforementioned shoe cover dispensing system, wherein, the opening module comprises two or more sets of drag hooks operating in circulation, which are adapted for opening the shoe cover.

The aforementioned shoe cover dispensing system, wherein, the opening module further comprises two conveyor belts rotating synchronously, two sets of drag hooks are provided, which are both fixedly connected on the inside of the two conveyor belts, the first set and the second set of drag hooks are arranged evenly on the circumferential direction of the conveyor belts; or, the opening module further comprises two cycle chains rotating synchronously, two sets of drag hooks are provided, which are both fixedly connected on the inside of the two cycle chains, the first set and the second set of drag hooks are arranged evenly on the circumferential direction of the cycle chains.

The aforementioned shoe cover dispensing system, wherein, the drag hook is provided with a U-shaped notch, and the width of the U-shaped notch is wider than the width of the claw, so as to allow the claw to be able to pass through the U-shaped notch; or, the drag hook is L-shaped, and one end of the L-shaped drag hook is able to pass by the inner side of the claw.

The aforementioned shoe cover dispensing system, wherein, a pair of relay poles of the relay module are provided, which are arranged at the inner side of the claws and deviate a distance along the direction of the drag hooks opening the shoe cover.

The aforementioned shoe cover dispensing system, wherein, the relay poles have unfolded status and folded status, the relay poles are connected to a swing structure or a stretch structure, so as to achieve unfolding and folding.

The aforementioned shoe cover dispensing system, wherein, the opening module comprises a pair of frames, and sliding rails are provided on the bottom of the frames.

The aforementioned shoe cover dispensing system, wherein, the shoe covers are arranged in flat state and in stacked manner in the shoe cover storage module; the elongating direction of the shoe cover is consistent with the elongating direction of the elongated opening.

The aforementioned shoe cover dispensing system, wherein, the shoe cover storage module is arranged on top of the extracting module, with the elongated opening oriented downwards, the opening module is arranged below the extracting module, with the shoe cover receiving end of the opening module arranged close to the extracting module, and the relay module is arranged close to the shoe cover receiving end of the opening module; the extracting module comprises a reverse-flighted screw rod and a pair of nuts with screw-threads of inverse directions, a pair of the claws are fixedly connected on a pair of the nuts, respectively, or the claws are integrated with the nuts to form a whole piece respectively; and the extracting module further comprises a guiding unit adapted for constraining the rotation of the claws; the guiding unit comprises a locating frame provided with a locating slot along the elongating direction of the reverse-flighted screw rod, and the claws are constrained within the locating slot of the locating frame; or, the guiding unit comprises a locating shaft provided along the elongating direction of the reverse-flighted screw rod, the claws have guiding apertures corresponding to the locating shaft, and the claws are sleeved onto the locating shaft through the guiding apertures; the extracting module further comprises a locating device for fastening the guiding unit; the extracting module further comprises an oscillating arm connected to the guiding unit, and a decelerating mechanism through which the guiding unit is connected in mechanical linkage with the screw rod; the extracting module further comprises an oscillating arm connected to the guiding unit, and a decelerating mechanism through which the guiding unit is connected in mechanical linkage with the screw rod; the oscillating arm is connected to the guiding unit through a clutch mechanism; the decelerating mechanism is a gear mechanism comprising an input gear fixed on the reverse-flighted screw rod, a dual gear engaged with the input gear, an output gear engaged with the dual gear, and an oscillating arm fixedly connected on the output gear, or, the decelerating mechanism is a synchronous belt decelerating mechanism; the clutch mechanism comprises an arc-shaped slot provided on the oscillating arm and a pin provided inside the arc-shaped slot, the pin is fixedly connected on the locating frame, or, the clutch mechanism comprises an arc-shaped slot provided on the locating frame and a pin provided inside the arc-shaped slot, the pin is fixedly connected on the oscillating arm; the extracting module comprises a shell, the locating device is fixedly connected on the shell, the locating device has locating status and disengaged status; when the oscillating arm and the guiding unit are disengaged through the clutch mechanism, the locating device is at the locating status; when the oscillating arm and the guiding unit are engaged through the clutch mechanism, the locating device is at the disengaged status; the locating device comprises a magnet provided on the locating device or on the guiding unit, and attraction force is formed between the locating device and the guiding unit; the opening module comprises two or more sets of drag hooks operating in circulation, which are adapted for opening the shoe cover; the opening module further comprises two conveyor belts rotating synchronously, two sets of drag hooks are provided, which are both fixedly connected on the inside of the two conveyor belts, the first set and the second set of drag hooks are arranged evenly on the circumferential direction of the conveyor belts; or, the opening module further comprises two cycle chains rotating synchronously, two sets of drag hooks are provided, which are both fixedly connected on the inside of the two cycle chains, the first set and the second set of drag hooks are arranged evenly on the circumferential direction of the cycle chains; the drag hook is provided with a U-shaped notch, and the width of the U-shaped notch is wider than the width of the claw, so as to allow the claw to be able to pass through the U-shaped notch, or, the drag hook is L-shaped, and one end of the L-shaped drag hook is able to pass by the inner side of the claw; a pair of relay poles of the relay module are provided, which are arranged at the inner side of the claws and deviate a distance along the direction of the drag hooks opening the shoe cover; the relay poles have unfolded status and folded status, the relay poles are connected to a swing structure or a stretch structure, so as to achieve unfolding and folding; the opening module comprises a pair of frames, and sliding rails are provided on the bottom of the frames; the shoe covers are arranged in flat state and in stacked manner in the shoe cover storage module; the elongating direction of the shoe cover is consistent with the elongating direction of the elongated opening.

The aforementioned shoe cover dispensing system, wherein, the guiding unit is connected to an inverting motor adapted for driving the guiding unit to invert around the axis of the reverse-flighted screw rod, so as to drive the claws to invert.

The aforementioned shoe cover dispensing system, wherein, the guiding unit is connected to an inverting motor adapted for driving the guiding unit to invert around the axis of the reverse-flighted screw rod, so as to drive the claws to invert.

The aforementioned shoe cover dispensing system, wherein, the relay poles are stationary.

The aforementioned shoe cover dispensing system, wherein, when the claw is at the position of passing the shoe cover on to the relay pole, the claw aligns with the relay pole in the opening direction of the shoe cover.

The aforementioned shoe cover dispensing system, wherein, the relay pole is provided with a step structure adapted for avoiding a collision with the claw.

The aforementioned shoe cover dispensing system, wherein, the opening module comprises two or more sets of drag hooks operating in circulation, which are adapted for opening the shoe cover.

The aforementioned shoe cover dispensing system, wherein, the opening module further comprises two conveyor belts rotating synchronously, two sets of drag hooks are provided, which are both fixedly connected on the inside of the two conveyor belts, the first set and the second set of drag hooks are arranged evenly on the circumferential direction of the conveyor belts; or, the opening module further comprises two cycle chains rotating synchronously, two sets of drag hooks are provided, which are both fixedly connected on the inside of the two cycle chains, the first set and the second set of drag hooks are arranged evenly on the circumferential direction of the cycle chains.

The aforementioned shoe cover dispensing system, wherein, the drag hook is provided with a U-shaped notch, and the width of the U-shaped notch is wider than the width of the claw, so as to allow the claw to be able to pass through the U-shaped notch; or, the drag hook is L-shaped, and one end of the L-shaped drag hook is able to pass by the inner side of the claw.

The aforementioned shoe cover dispensing system, wherein, when the drag hook begins to open the shoe cover, the position of the relay pole is more forward than the position of the claw in the opening direction of the shoe cover, and the bottom of the relay pole is lower than the bottom of the claw; when the drag hook has become in front of the relay pole in the opening direction of the shoe cover, the claw begins to fold to the middle, so as to pass the shoe cover on to the relay pole.

The aforementioned shoe cover dispensing system, wherein, when the drag hook is at the position of aligning with the relay pole in the opening direction of the shoe cover, the drag hook is below the bottom of the relay pole.

The aforementioned shoe cover dispensing system, wherein, the opening module comprises two or more sets of drag hooks operating in circulation, which are adapted for opening the shoe cover.

The aforementioned shoe cover dispensing system, wherein, the opening module further comprises two conveyor belts rotating synchronously, two sets of drag hooks are provided, which are both fixedly connected on the inside of the two conveyor belts, the first set and the second set of drag hooks are arranged evenly on the circumferential direction of the conveyor belts; or, the opening module further comprises two cycle chains rotating synchronously, two sets of drag hooks are provided, which are both fixedly connected on the inside of the two cycle chains, the first set and the second set of drag hooks are arranged evenly on the circumferential direction of the cycle chains.

The aforementioned shoe cover dispensing system, wherein, the shoe cover dispensing system further comprises rear-end conveyor belt wheels or rear-end chain wheels, the drag hook begins to open the shoe cover at the horizontally rear end point of the rear-end conveyor belt wheel or the rear-end chain wheel, the horizontal projection of the relay pole is within the area of the rear-end conveyor belt wheel or the rear-end chain wheel, so as to ensure that when the drag hook is at the position of aligning with the relay pole, the drag hook is below the bottom of the relay pole.

The aforementioned shoe cover dispensing system, wherein, the drag hook is provided with a U-shaped notch, and the width of the U-shaped notch is wider than the width of the claw, so as to allow the claw to be able to pass through the U-shaped notch; or, the drag hook is L-shaped, and one end of the L-shaped drag hook is able to pass by the inner side of the claw.

The objectives of the present invention are also achieved by providing a shoe cover dispensing system, comprising a shoe cover storage module, an extracting module and an opening module, wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the shoe covers are arranged in flat state and in stacked manner in the shoe cover storage module; the elongating direction of the shoe cover is consistent with the elongating direction of the elongated opening, and the direction of the claws propping the shoe cover open is also consistent with the elongating direction of the elongated opening.

The aforementioned shoe cover dispensing system, wherein, the shoe cover storage module is arranged on top of the extracting module, with the elongated opening oriented downwards, and the opening module is arranged below the extracting module, with the shoe cover receiving end of the opening module arranged close to the extracting module.

The aforementioned shoe cover dispensing system, wherein, the extracting module comprises a reverse-flighted screw rod and a pair of nuts with screw-threads of inverse directions, a pair of the claws are fixedly connected on a pair of the nuts, respectively, or the claws are integrated with the nuts to form a whole piece respectively; and the extracting module further comprises a guiding unit adapted for constraining the rotation of the claws, an oscillating arm, and a locating device adapted for fastening the guiding unit; the claws are constrained to slip along the guiding unit.

The aforementioned shoe cover dispensing system, wherein, the extracting module further comprises a decelerating mechanism through which the locating frame is connected in mechanical linkage with the screw rod; the oscillating arm is connected to the locating frame through a clutch mechanism; the clutch mechanism comprises an arc-shaped slot provided on the oscillating arm and a pin provided inside the arc-shaped slot, the pin is fixedly connected on the locating frame.

The objectives of the present invention are also achieved by providing a shoe cover dispensing system, comprising an extracting module, wherein, the extracting module is provided with a pair of claws which are able to be propped open and inverted; the front end of each of the claws is provided with a hook portion, two hook portions of a pair of the claws are arranged back to back; a chamfer for relaying or an arc for relaying is provided on the backside surface of the front end of each of the claws, the backside surface is opposite to the inverting direction of each of the claws.

The shoe cover dispensing method and system of the present invention, comprising a storage module and an extracting module with the shoe covers pre-stored in the storage module for the extracting module to extract, are convenient for pre-storing shoe covers with more pre-stored shoe covers contained at one time, compared with the prior art, and the pre-storing is also convenient; the extracting module extracts the shoe covers by the propping open and inverting of the claws, so that the accuracy requirements for pre-storing the shoe covers are low; the storage module, the extracting module and the opening module of the present invention are set separately, so as to make full use of the resource of space for positioning and save the occupied space; the extracting module and the opening module of the present invention are set separately and able to operate in circulation independently respectively, which, compared with the prior art, has the feature of high operating efficiency.

DETAILED DESCRIPTION OF THE PREFERRED EMBODIMENTS

Figure 1:
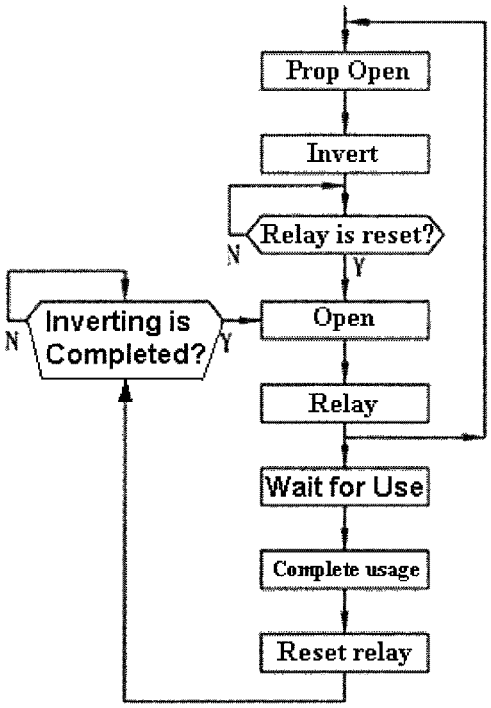
FIG. 1 is a flow chart of the first embodiment of the present invention.

The present invention is further illustrated in detail, in conjunction with the accompanying drawings, as follows:

Referring to FIG. 1, a first embodiment of the present invention is a shoe cover dispensing method, with a shoe cover storage module, an extracting module, an opening module and a relay module, comprising the following steps: S1: propping a shoe cover open; S2: inverting; S3: determining if relay has been reset, and if not then repeating step S3; S4: opening; S5: relaying; S6: waiting for use; S7: completing usage; S8: resetting the relay; S9: determining if the inverting has been completed, and if not then repeating step S9; S10: jumping to step S4; wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; and, propping of step S1 refers to propping the elastic mouth of each shoe cover open inside the elongated opening by the claws of the extracting module; inverting of step S2 refers to extracting the shoe cover out of the storage module by the claws of the extracting module through inverting motion; determining of step S3 refers to determining if the relay has been reset, and if the relay has not been reset, then repeating step S3, and if the relay has been reset then jumping to the next step; opening of step S4 refers to hooking the elastic mouth of the shoe cover by the drag hooks of the opening module and by the drag hooks of the opening module and moving the drag hooks relative to the claws, thus opening the elastic mouth of the shoe cover; relaying of step S5 refers to unfolding the relay poles of the relay module and receiving the shoe cover from the claws by the relay poles, thus allowing the relay poles to keep the elastic mouth of the shoe cover in propped state instead of the claws in conjunction with the drag hooks, when the claws are inverted back to the elongated opening and the next step S1 of propping are started; resetting the relay of step S8 refers to folding the relay poles to a status the same as that before the relaying step; determining of step S9 refers to determining if the inverting has been completed, and if it has not been completed then repeating step S9, and if the inverting has been completed then jumping to step S4 so as to enter the next loop.

Preferably, the elongating direction of the shoe cover is consistent with the elongating direction of the elongated opening, and movement of the claws for propping the elastic mouth open is a rectilinear motion in the elongating direction of the elongated opening. The effect of the rectilinear motion is that the claws may prop open from a very short distance away to a very long distance away inside the elastic mouth, so that the requirements of accuracy for pre-storing the shoe covers are low, which lowers the cost of pre-storing.

Preferably, the elongating direction of the shoe cover is consistent with the elongating direction of the elongated opening, and movement of the claws for propping the elastic mouth open is a rectilinear motion in the elongating direction of the elongated opening. The rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively. The effect of performing this rectilinear motion by means of screws is that the movement is reliable, the control is simple, and driving force can be provided for the inversion of the claws.

Preferably, the drag hook is provided with a U-shaped notch, and at the beginning of the opening step, two ends of the notch of the drag hook pass by two sides of the claw when the elastic mouth of the shoe cover is hooked by one end of the notch of the drag hook. The effect of the U-shaped drag hook is that the opening of the shoe cover can be completed during the movement of the U-shaped drag hook. The effect of the U-shaped drag hook is also that the length of the drag hook is reduced, so as to save the occupied space of the mechanism for opening. It should be understood that, a solution which may replace the U-shaped drag hook is that the drag hook is L-shaped, and at the beginning of the opening step, one end of the L-shaped drag hook passes by an inner side of the claw and hooks the elastic mouth of the shoe cover. The U-shape and L-shape mentioned in the present invention refer to the shape of the drag hook on the plane perpendicular to its moving direction, which can be the cross-sectional shape of the drag hook, the projection shape of the drag hook or the shape of the movement track of the drag hook.

Preferably, the drag hook is provided with a U-shaped notch, and at the beginning of the opening step, two ends of the notch of the drag hook pass by two sides of the claw when the elastic mouth of the shoe cover is hooked by one end of the notch of the drag hook. It should be understood that, a solution which may replace the U-shaped drag hook is that the drag hook is L-shaped, and at the beginning of the opening step, one end of the L-shaped drag hook passes by an inner side of the claw and hooks the elastic mouth of the shoe cover. Two sets of drag hooks are provided and adapted for operating alternately, when one set of drag hooks complete the opening step, the other set of drag hooks are reset and prepared for receiving the next shoe cover, so as to save the time for returning the drag hooks.

Preferably, a pair of the relay poles with free ends are provided, during the relaying step the free ends of the relay poles swing downward or extend downward, and during the relay resetting step the free ends of the relay poles swing upward or retract upward. By adopting the swinging-out/swinging-back mode, or the extending/retracting mode, the relay poles can avoid (the front ends in the opening direction of) the shoe cover when the drag hooks open the shoe cover, and then, by swinging out or extending, the relay poles can receive (the rear ends in the opening direction of) the shoe cover.

Preferably, a pair of the relay poles with free ends are provided, during the relaying step the free ends of the relay poles swing downward or extend downward, and during the relay resetting step the free ends of the relay poles swing upward or retract upward. A chamfer for relaying or an arc for relaying is provided on a backside of each of the claws, so as to facilitate the withdrawing of the claws when resetting the relay.

Preferably, the shoe covers are arranged in flat state and in stacked manner in the shoe cover storage module. This specific solution can be combined with any of the aforementioned preferred implementation ways, and by adopting the laminated stacking mode, the cost of pre-storing is lowered.

Preferably, the shoe cover is opened in width direction thereof. This specific solution can be combined with any of the aforementioned preferred implementation ways, and by opening in the width direction, the stroke of opening is short, the time of opening is saved, and the occupied space of the mechanism for opening is saved. Accordingly, the stroke along the propping-open direction of the shoe cover is long, so that the claws have a relatively long propping-open distance, and the requirements of accuracy for placing the shoe covers are low.

It should be understood that, preferably, the preceding implementation ways can be implemented in combination at the same time. The elongating direction of the shoe cover is consistent with the elongating direction of the elongated opening, and movement of the claws for propping the elastic mouth open is a rectilinear motion in the elongating direction of the elongated opening; the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively; the drag hook is provided with a U-shaped notch, and at the beginning of the opening step, two ends of the notch of the drag hook pass by two sides of the claw when the elastic mouth of the shoe cover is hooked by one end of the notch of the drag hook; two sets of drag hooks are provided and adapted for operating alternately, when one set of drag hooks complete the opening step, the other set of drag hooks are reset and prepared for receiving the next shoe cover, so as to save the time for returning the drag hooks; a pair of the relay poles with free ends are provided, during the relaying step the free ends of the relay poles swing downward or extend downward, and during the relay resetting step the free ends of the relay poles swing upward or retract upward; a chamfer for relaying or an arc for relaying is provided on a backside of each of the claws; the shoe covers are arranged in flat state and in stacked manner in the shoe cover storage module; the shoe cover is opened in width direction thereof. A solution which may replace the U-shaped drag hook is that the drag hook is L-shaped, and at the beginning of the opening step, one end of the L-shaped drag hook passes by an inner side of the claw and hooks the elastic mouth of the shoe cover.

Figure 2:
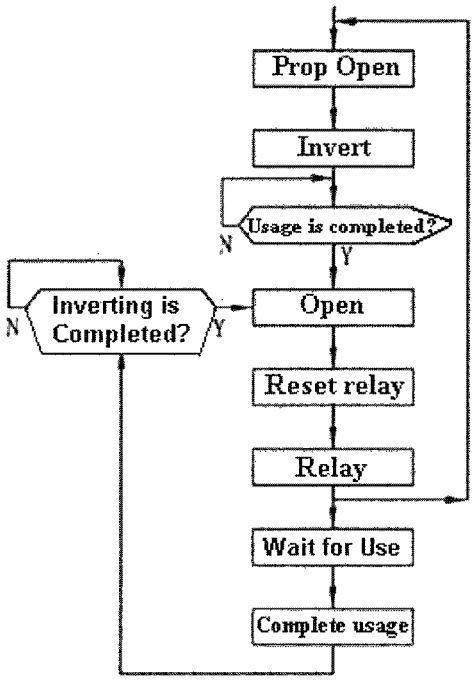
FIG. 2 is a flow chart of the second embodiment of the present invention.

Referring to FIG. 2, a second embodiment of the present invention is a shoe cover dispensing method, with a shoe cover storage module, an extracting module, an opening module and a relay module, comprising the following steps: S1: propping a shoe cover open; S2: inverting; S3: determining if the usage has been completed, and if not then repeating step S3; S4: opening; S5: resetting the relay; S6: relaying; S7: waiting for use; S8: completing usage; S9: determining if the inverting has been completed, and if not then repeating step S9; S10: jumping to step S4; wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; and, propping of step S1 refers to propping the elastic mouth of each shoe cover open inside the elongated opening by the claws of the extracting module; inverting of step S2 refers to extracting the shoe cover out of the storage module by the claws of the extracting module through inverting motion; determining of step S3 refers to determining if the usage has been completed, and if not then repeating step S3, and if the usage has been completed then jumping to the next step; opening of step S4 refers to hooking the elastic mouth of the shoe cover by the drag hooks of the opening module and by the drag hooks of the opening module and moving the drag hooks relative to the claws, thus opening the elastic mouth of the shoe cover; resetting the relay of step S5 refers to folding the relay poles before the drag hooks pass a relaying position at which the unfolded relay poles stay; relaying of step S6 refers to unfolding the relay poles of the relay module and receiving the shoe cover from the claws by the relay poles, thus allowing the relay poles to keep the elastic mouth of the shoe cover in propped state instead of the claws in conjunction with the drag hooks, when the claws are inverted back to the elongated opening and the next step S1 of propping are started; determining of step S9 refers to determining if the inverting has been completed, and if it has not been completed then repeating step S9, and if the inverting has been completed then jumping to step S4 so as to enter the next loop. In this solution, the relay resetting is set after the opening step, because after the opening step starts, the drag hooks and the front ends (in the opening direction) of the shoe cover do not immediately pass the position at which the relay poles are, therefore, this solution finishes the relay resetting before the drag hooks passes by the position of the relay poles.

Preferably, the elongating direction of the shoe cover is consistent with the elongating direction of the elongated opening, and movement of the claws for propping the elastic mouth open is a rectilinear motion in the elongating direction of the elongated opening; the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively; the drag hook is provided with a U-shaped notch, and at the beginning of the opening step, two ends of the notch of the drag hook pass by two sides of the claw when the elastic mouth of the shoe cover is hooked by one end of the notch of the drag hook; two sets of drag hooks are provided and adapted for operating alternately, when one set of drag hooks complete the opening step, the other set of drag hooks are reset and prepared for receiving the next shoe cover, so as to save the time for returning the drag hooks; a pair of the relay poles with free ends are provided, during the relaying step the free ends of the relay poles swing downward or extend downward, and during the relay resetting step the free ends of the relay poles swing upward or retract upward; a chamfer for relaying is provided on a backside of each of the claws; the shoe covers are arranged in flat state and in stacked manner in the shoe cover storage module; the shoe cover is opened in width direction thereof. A solution which may replace the U-shaped drag hook is that the drag hook is L-shaped, and at the beginning of the opening step, one end of the L-shaped drag hook passes by an inner side of the claw and hooks the elastic mouth of the shoe cover.

Figure 3:
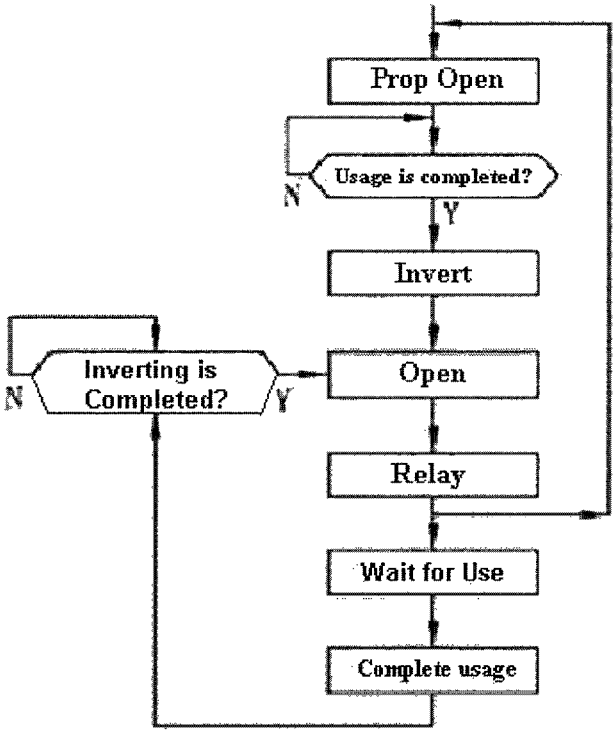
FIG. 3 is a flow chart of the third embodiment of the present invention.

Referring to FIG. 3, a third embodiment of the present invention is a shoe cover dispensing method, with a shoe cover storage module, an extracting module, an opening module and a relay module, comprising the following steps: S1: propping a shoe cover open; S2: determining if the usage has been completed, and if not then repeating step S2; S3: inverting; S4: opening; S5: relaying; S6: waiting for use; S7: completing usage; S8: determining if the inverting has been completed, and if not then repeating step S8; S9: jumping to step S4; wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; the position of the claw at step S5 aligns with the relay pole in the opening direction of the shoe cover; because these two align with each other, when the last shoe cover has not yet completed usage, the next shoe cover cannot be inverted to the position of relaying, or else it will generate interference with the last shoe cover, therefore, step S2 is necessary; and, propping of step S1 refers to propping the elastic mouth of each shoe cover open inside the elongated opening by the claws of the extracting module; inverting of step S3 refers to delivering the shoe cover to a relay position by the claws of the extracting module through inverting motion, and allowing the elastic mouth of the shoe cover to encompass the relay poles; opening of step S4 refers to hooking the elastic mouth of the shoe cover by the drag hooks of the opening module and by the drag hooks of the opening module and moving the drag hooks relative to the claws, thus opening the elastic mouth of the shoe cover; relaying of step S5 refers to acting a dragging force on the elastic mouth of the shoe cover by the drag hooks, allowing the elastic mouth of the shoe cover to detach from the claws and slip to the relay poles, thus allowing the relay poles to keep the elastic mouth of the shoe cover in propped state instead of the claws in conjunction with the drag hooks, when the claws are inverted back to the elongated opening and the next step S1 of propping are started; determining of step S8 refers to determining if the inverting has been completed, and if it has not been completed then repeating step S8, and if the inverting has been completed then jumping to step S4 so as to enter the next loop.

In this embodiment, the relay poles are set stationary, and each relay pole is provided with a step structure adapted for avoiding a collision with the claw. The relaying in this embodiment is different from those in the preceding two embodiments, mainly because the relay poles are stationary and the relaying process is determined by the position of the relay poles; during the relaying step S5 in this embodiment, the dragging force of the drag hooks is acted on the elastic mouth of the shoe cover, and meanwhile the claws move towards the middle, so as to cause the elastic mouth of the shoe cover to detach from the claws and slip to the relay poles. It should be understood that, although the relay poles in this embodiment are stationary and this configuration is enough to perform the relaying, however, as an alternative solution of this embodiment, the relay poles may also be able to be unfolded and folded.

The elongating direction of the shoe cover is consistent with the elongating direction of the elongated opening, and movement of the claws for propping the elastic mouth open is a rectilinear motion in the elongating direction of the elongated opening. The rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively. The drag hook is provided with a U-shaped notch, and at the beginning of the opening step, two ends of the notch of the drag hook pass by two sides of the claw when the elastic mouth of the shoe cover is hooked by one end of the notch of the drag hook; it should be understood that, as an alternative solution, the present invention may also be implemented with L-shaped drag hooks, that is, the drag hook is L-shaped, and at the beginning of the opening step, one end of the L-shaped drag hook passes by an inner side of the claw and hooks the elastic mouth of the shoe cover. In this embodiment, two sets of drag hooks are provided and adapted for operating alternately, when one set of drag hooks complete the opening step, the other set of drag hooks are reset and prepared for receiving the next shoe cover, so as to save the time for returning the drag hooks.

As for the implementation of the third embodiment of the present invention, the relay module of the seventh embodiment of the present invention may also be referenced.

Figure 4:
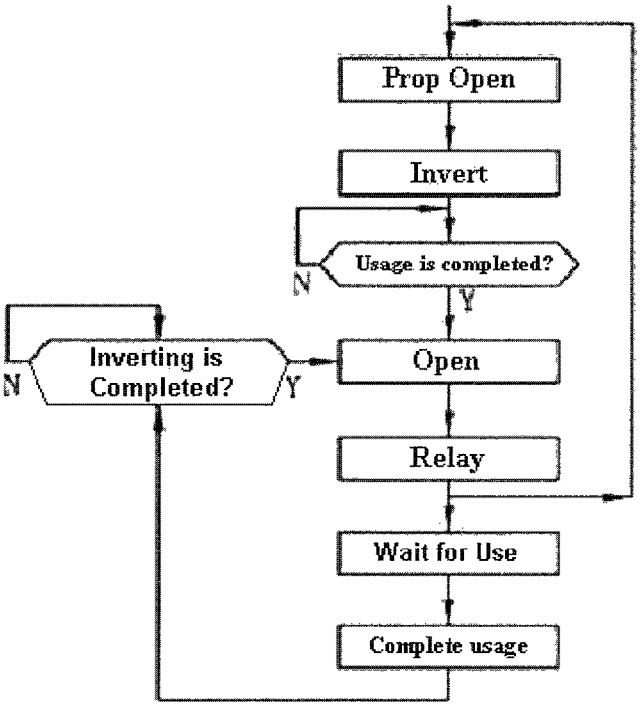
FIG. 4 is a flow chart of the fourth embodiment of the present invention.
Figure 5:
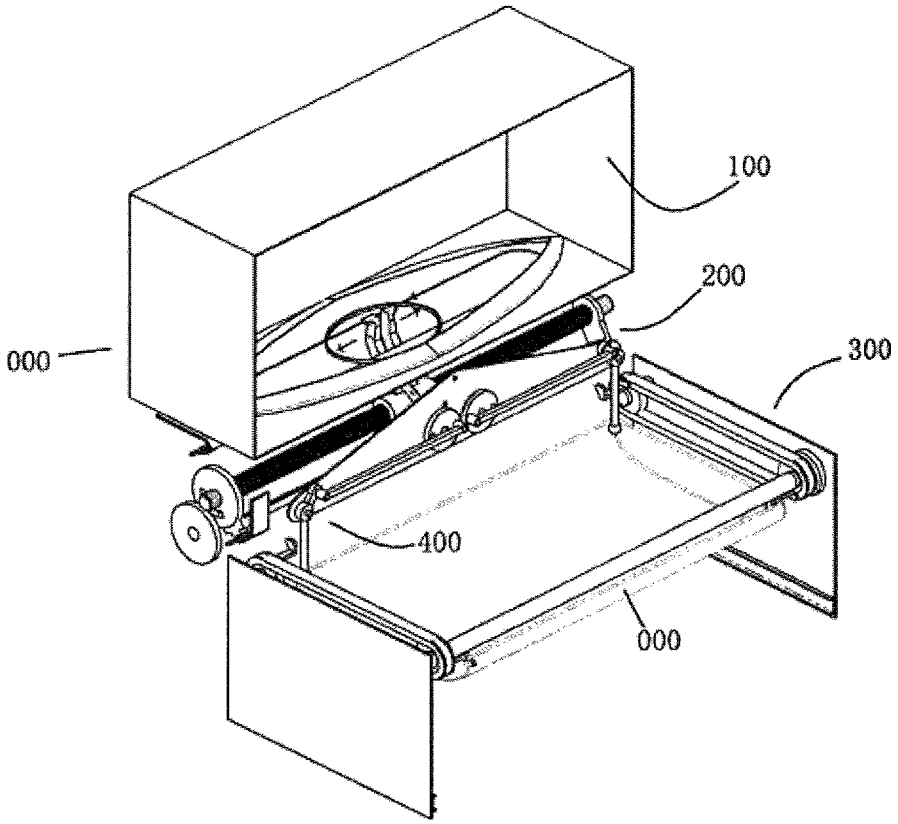
FIG. 5 is a schematic diagram of the sixth embodiment of the present invention.
Figure 6:
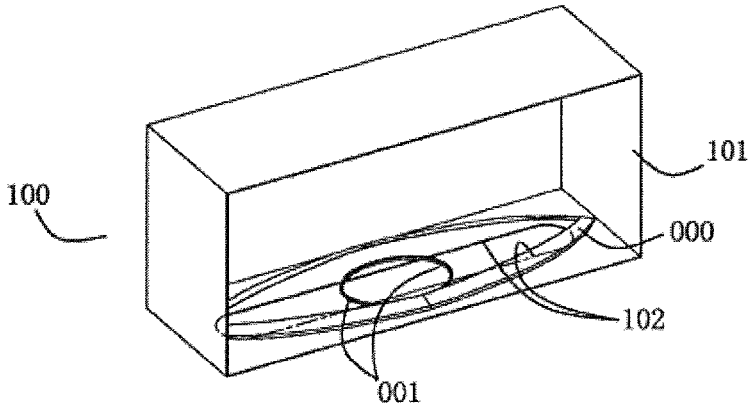
FIG. 6 is a schematic diagram of the storage module of the sixth embodiment of the present invention.
Figure 7:
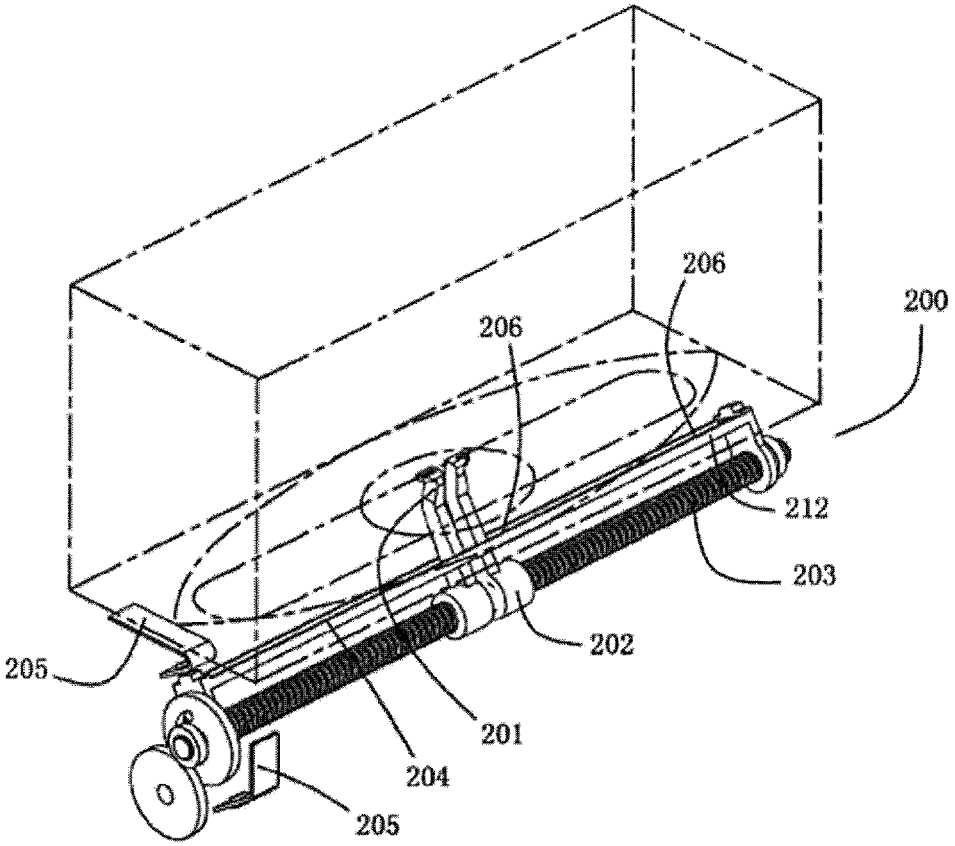
FIG. 7 is a schematic diagram of the extracting module of the sixth embodiment of the present invention.
Figure 8:
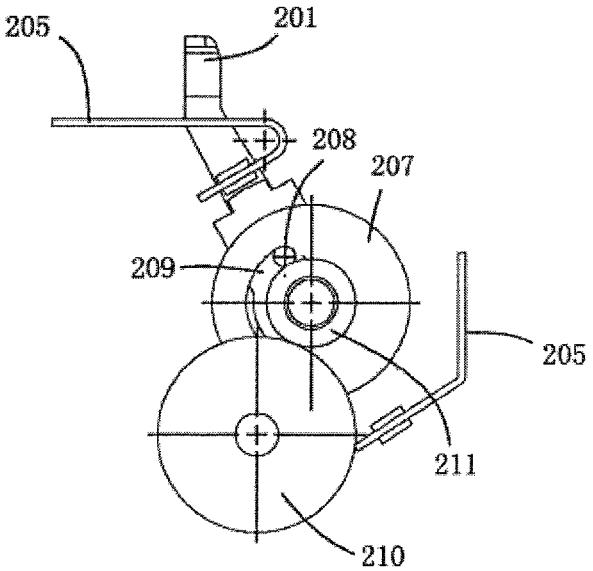
FIG. 8 is a side view of the extracting module, at the propping open status, of the sixth embodiment of the present invention.
Figure 9:
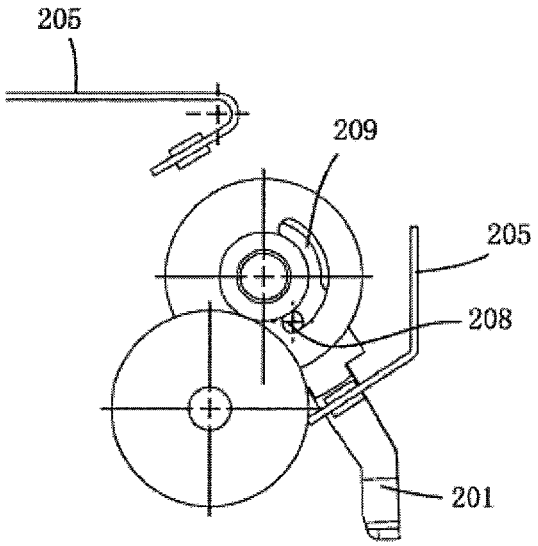
FIG. 9 is a side view of the extracting module, at the opening status, of the sixth embodiment of the present invention.
Figure 10:
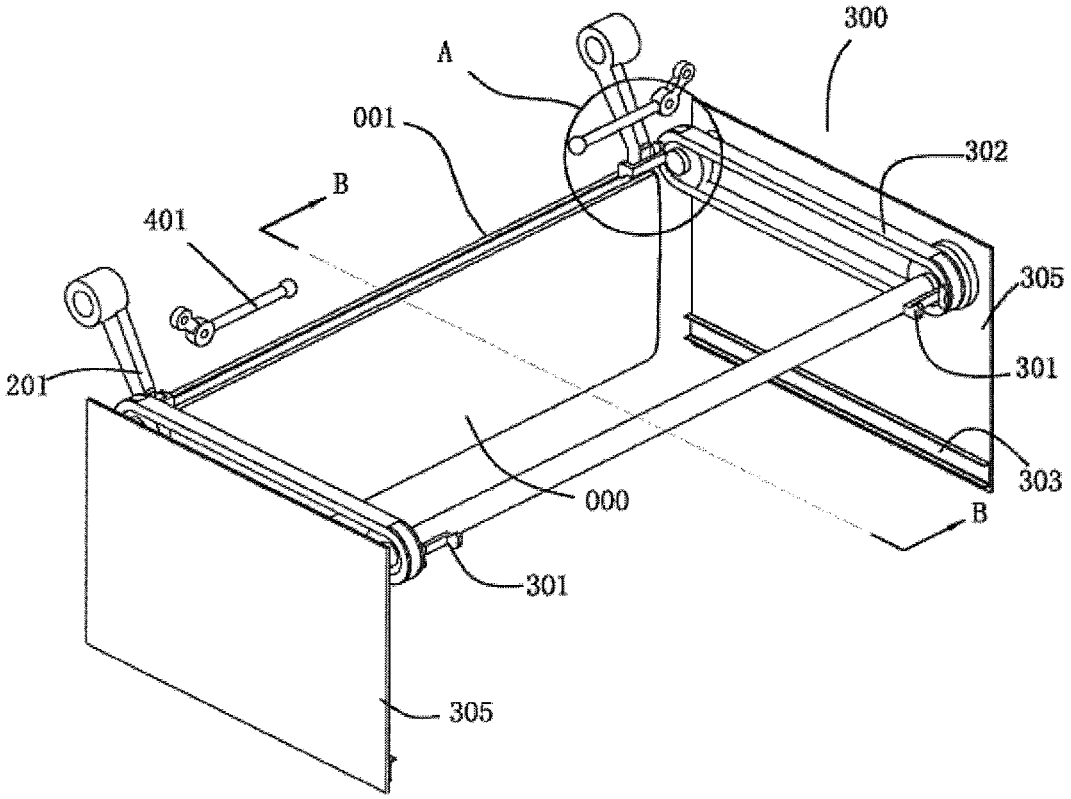
FIG. 10 is a schematic diagram of the opening module of the sixth embodiment of the present invention.
Figure 11:
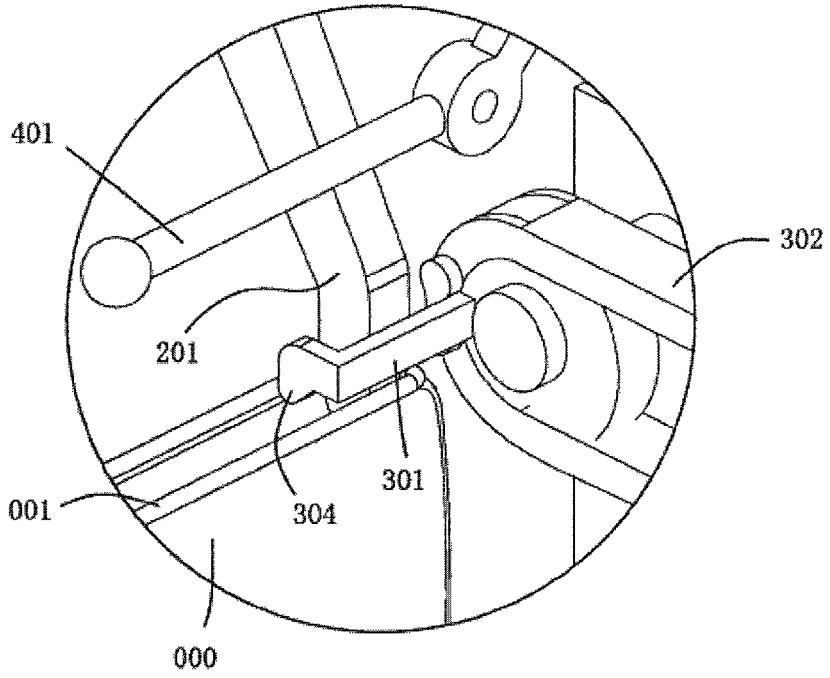
FIG. 11 is a partial enlarged drawing of area A in FIG. 10.
Figure 12:
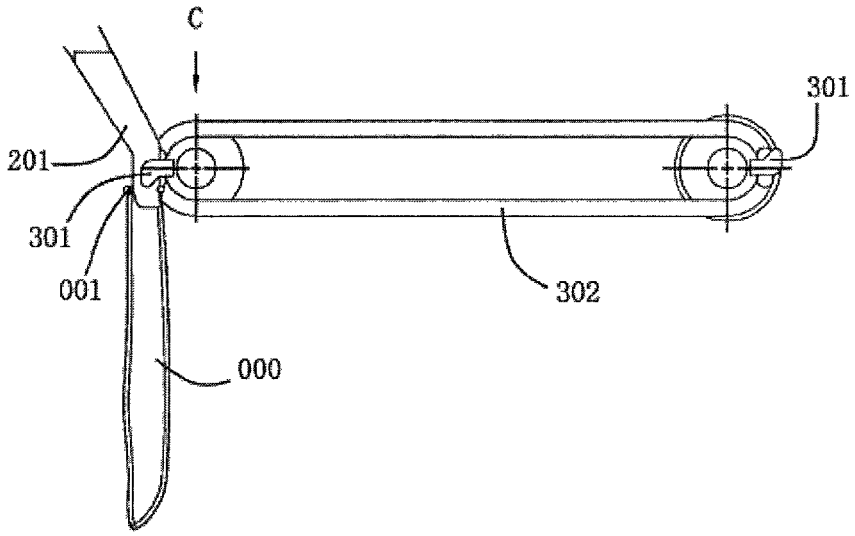
FIG. 12 is a section view along line B-B in FIG. 10.
Figure 13:
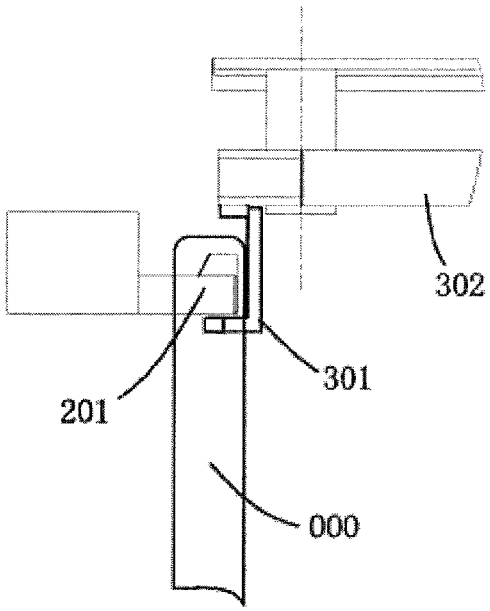
FIG. 13 is a partial view from direction C in FIG. 12.
Figure 14:
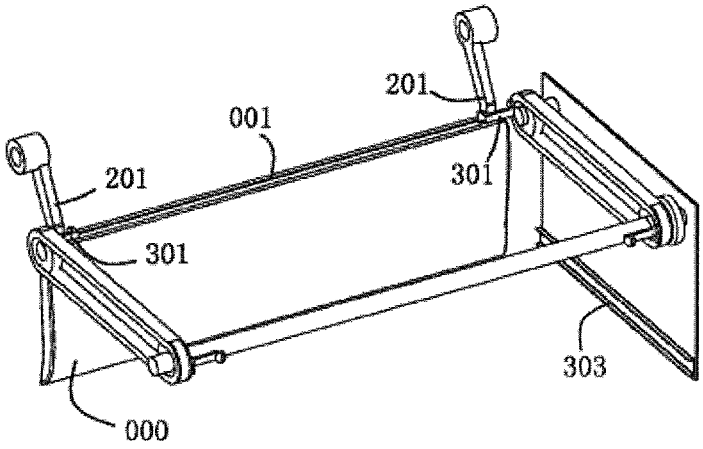
FIG. 14 is a schematic diagram of the drag hooks pulling the elastic mouth open from the claws, as in the sixth embodiment of the present invention.
Figure 15:
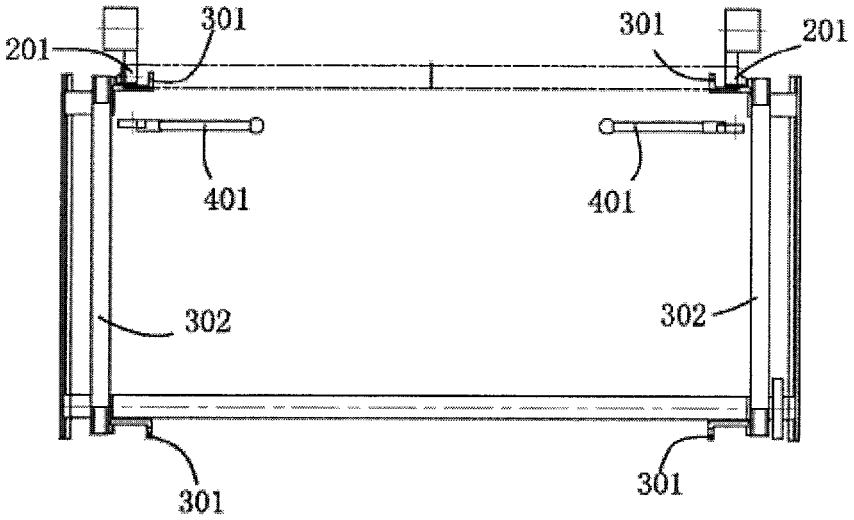
FIG. 15 is a vertical view of the status showed in FIG. 14.
Figure 16:
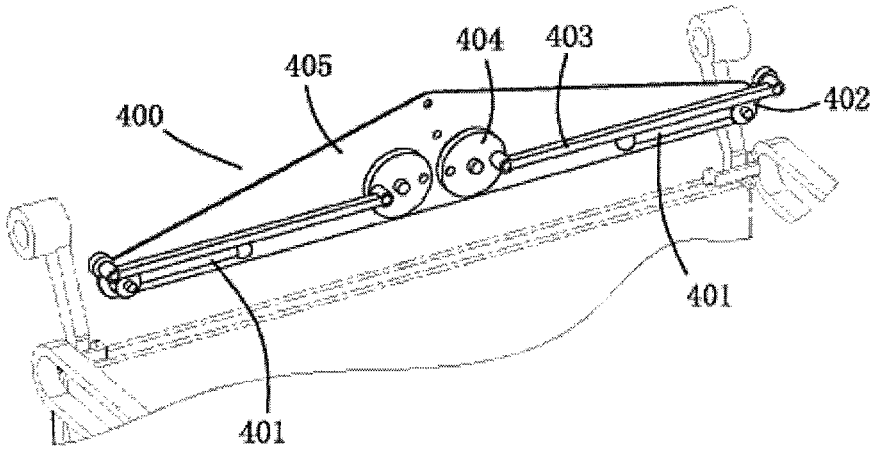
FIG. 16 is a schematic diagram of the relay module of the sixth embodiment of the present invention.
Figure 17:
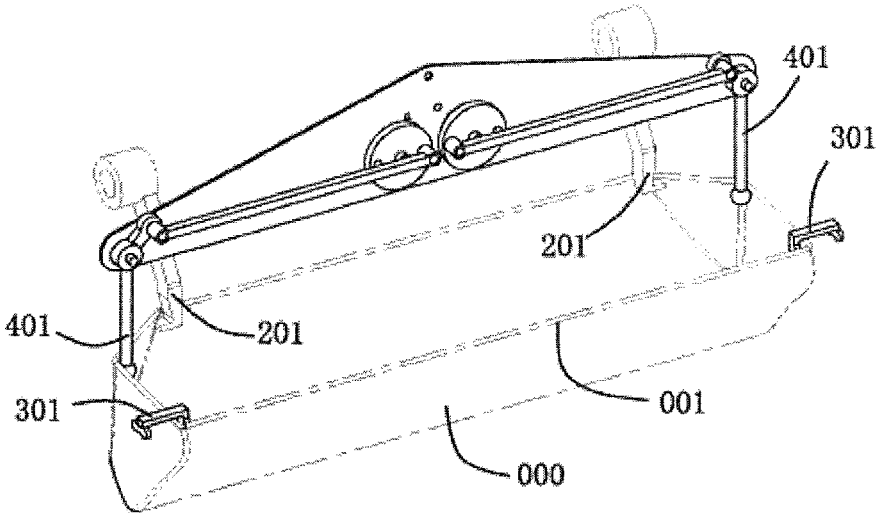
FIG. 17 is a schematic diagram of the relaying status of the sixth embodiment of the present invention.
Figure 18:
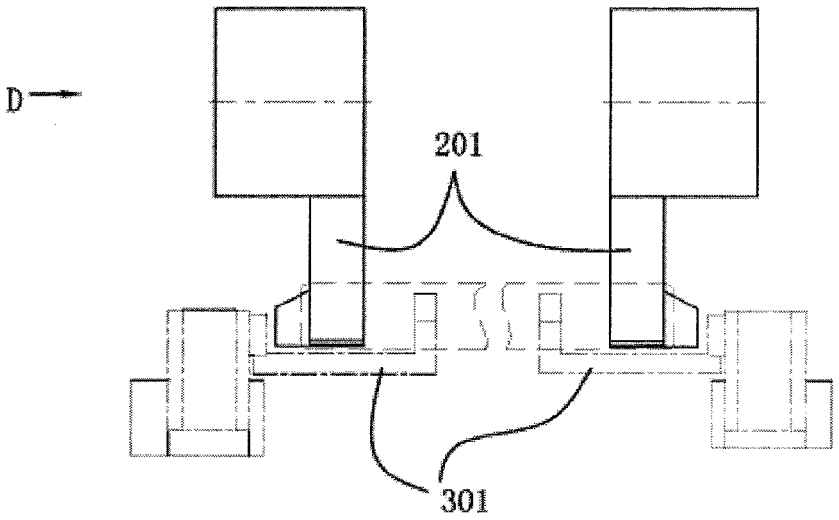
FIG. 18 is a schematic diagram of the claw at the status showed in FIG. 14.

Referring to FIG. 4, a fourth embodiment of the present invention is a shoe cover dispensing method, with a shoe cover storage module, an extracting module, an opening module and a relay module, comprising the following steps: S1: propping a shoe cover open; S2: inverting; S3: determining if the usage has been completed, and if not then repeating step S3; S4: opening; S5: relaying; S6: waiting for use; S7: completing usage; S8: determining if the inverting has been completed, and if not then repeating step S8; S9: jumping to step S4; wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; the relay poles are set stationary, and in the opening direction of the shoe cover, the position of the relay pole is more forward than the position of the claw at step S5, and the drag hooks pass by below the bottom of the relay poles when performing step S4; and, propping of step S1 refers to propping the elastic mouth of each shoe cover open inside the elongated opening by the claws of the extracting module; inverting of step S2 refers to extracting the shoe cover out of the storage module by the claws of the extracting module through inverting motion; opening of step S4 refers to hooking the elastic mouth of the shoe cover by the drag hooks of the opening module and by the drag hooks of the opening module and moving the drag hooks relative to the claws, thus opening the elastic mouth of the shoe cover; relaying of step S5 refers to hanging the shoe cover onto the relay poles of the relay module by the claws and then inverting the claws back, thus allowing the relay poles to keep the elastic mouth of the shoe cover in propped state instead of the claws in conjunction with the drag hooks, and the next step S1 of propping are started when the claws are inverted back to the elongated opening; determining of step S8 refers to determining if the inverting has been completed, and if it has not been completed then repeating step S8, and if the inverting has been completed then jumping to step S4 so as to enter the next loop.

In this embodiment, relaying of step S5 is performed after the drag hooks pass by below the bottom of the relay poles in the opening step S4; relaying of step S5 is started before the completion of step S4, and step S6 is performed after the completion of both step S4 and step S5; the elongating direction of the shoe cover is consistent with the elongating direction of the elongated opening, and movement of the claws for propping the elastic mouth open is a rectilinear motion in the elongating direction of the elongated opening; the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively; the drag hook is provided with a U-shaped notch, and at the beginning of the opening step, two ends of the notch of the drag hook pass by two sides of the claw when the elastic mouth of the shoe cover is hooked by one end of the notch of the drag hook; it should be understood that, as an alternative solution of this embodiment, the present invention may also be implemented with L-shaped drag hooks, that is, the drag hook is L-shaped, and at the beginning of the opening step, one end of the L-shaped drag hook passes by an inner side of the claw and hooks the elastic mouth of the shoe cover. In this embodiment, two sets of drag hooks are provided and adapted for operating alternately, when one set of drag hooks complete the opening step, the other set of drag hooks are reset and prepared for receiving the next shoe cover, so as to save the time for returning the drag hooks.

As for the implementation of the fourth embodiment of the present invention, the relay module of the eighth embodiment of the present invention may also be referenced.

A fifth embodiment of the present invention is a shoe cover dispensing method, characterized in that, with a shoe cover storage module, an extracting module, an opening module and a relay module: the extracting module performs the following steps: SA1 propping a shoe cover open, referring to propping the shoe cover open inside the storage module by claws; SA2 inverting, referring to inverting the propped shoe cover to an opening/relay position; the opening module performs the following steps: SB1 opening, referring to opening the shoe cover by drag hooks; SB2 waiting for use, and using the shoe cover; the extracting module and the relay module together perform the following step: SC1 relaying, referring to hanging the back ends of the shoe cover onto the relay poles by the claws of the extracting module, and then inverting the claws back; the circulating operation of steps SB1 and SB2 and the circulating operation of steps SA1 and SA2 are performed simultaneously.

In this embodiment, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; the elongating direction of the shoe cover is consistent with the elongating direction of the elongated opening, and movement of the claws for propping the elastic mouth open is a rectilinear motion in the elongating direction of the elongated opening; the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively; the drag hook is provided with a U-shaped notch, and at the beginning of the opening step, two ends of the notch of the drag hook pass by two sides of the claw when the elastic mouth of the shoe cover is hooked by one end of the notch of the drag hook; it should be understood that, as an alternative solution of this embodiment, the present invention may also be implemented with L-shaped drag hooks, that is, the drag hook is L-shaped, and at the beginning of the opening step, one end of the L-shaped drag hook passes by an inner side of the claw and hooks the elastic mouth of the shoe cover. Two sets of drag hooks are provided and adapted for operating alternately, when one set of drag hooks complete the opening step, the other set of drag hooks are reset and prepared for receiving the next shoe cover, so as to save the time for returning the drag hooks.

Referring to FIGS. 5-20, a sixth embodiment of the present invention is a shoe cover dispensing system, comprising a shoe cover storage module 100, an extracting module 200, an opening module 300 and a relay module 400, wherein, the main body of the storage module is a box 101, the storage module is provided with an elongated opening 102, an elastic mouth 001 of each shoe cover 000 is placed towards the elongated opening 102; the extracting module 200 is provided with a pair of claws 201 which are able to be propped open and inverted; the opening module 300 is provided with drag hooks 301 adapted for opening the shoe cover; the relay module 400 is provided with relay poles 401 adapted for receiving the shoe cover from the claws 301. In this embodiment, the pair of claws may have a hook portion 2012 on each of the ends at the direction of propping the shoe cover open. In this embodiment, the shoe cover storage module 100 is arranged on top of the extracting module 200, with the elongated opening 102 oriented downwards, the opening module 300 is arranged below the extracting module 200, with the shoe cover 000 receiving end of the opening module 300 arranged close to the extracting module 200, and the relay module 400 is arranged close to the shoe cover 000 receiving end of the opening module 300.

Preferably, the extracting module 200 comprises a reverse-flighted screw rod 203 and a pair of nuts 202 with screw-threads of inverse directions, a pair of the claws 201 are fixedly connected on a pair of the nuts 202, respectively, or the claws 201 are integrated with the nuts 202 to form a whole piece respectively, this embodiment adopts the way of welding metal parts; the extracting module 200 further comprises a guiding unit adapted for constraining the rotation of the claws. The guiding unit comprises a locating frame 212, the locating frame 212 is provided with a locating slot 206 along the elongating direction of the reverse-flighted screw rod 203, and the claws 201 are constrained within the locating slot 206 of the locating frame 212; it should be understood that, the guiding unit is not limited to the aforementioned configuration, and as an alternative solution of this embodiment, the guiding unit comprises a locating shaft provided along the elongating direction of the reverse-flighted screw rod, the claws have guiding apertures corresponding to the locating shaft, and the claws are sleeved onto the locating shaft through the guiding apertures, and this configuration of shaft and apertures can also implement the present invention. The extracting module 200 further comprises a locating device 205 for fastening the guiding unit. The extracting module 200 further comprises an oscillating arm 207 connected to the guiding unit, and a decelerating mechanism through which the guiding unit is connected in mechanical linkage with the screw rod. The oscillating arm 207 is connected to the guiding unit (the locating frame or the locating shaft) through a clutch mechanism. The decelerating mechanism in this embodiment is a gear mechanism comprising an input gear 211 fixed on the reverse-flighted screw rod 203, a dual gear 210 engaged with the input gear, and an output gear (i.e. the oscillating arm) 207 engaged with the dual gear 210, wherein the output gear and the oscillating arm in this embodiment are integrated into one wheel, and it should be understood that they also can be two wheels and the output gear is fixedly connected to the oscillating arm; it should also be understood that, the decelerating mechanism is not limited to decelerating gear, as an alternative solution, the decelerating mechanism is a synchronous belt decelerating mechanism. The clutch mechanism comprises an arc-shaped slot 209 provided on the oscillating arm 207 and a pin 208 provided inside the arc-shaped slot 209, the pin 208 is fixedly connected on the locating frame 212. The clutch mechanism is not limited to the aforementioned configuration, other clutch mechanisms in the prior art may also be employed. The extracting module 200 comprises a shell, the locating device 205 is fixedly connected on the shell, the locating device 205 has locating status and disengaged status; when the oscillating arm 207 and the guiding unit are disengaged through the clutch mechanism, the locating device is at the locating status; when the oscillating arm and the guiding unit are engaged through the clutch mechanism, the locating device is at the disengaged status. It should be understood that, the aforementioned shell is a stationary part, and when the shoe cover dispensing system is applied to a shoe cover dispensing machine, this shell is fixedly connected on the machine frame of the shoe cover dispensing machine, or integrated with the machine frame to form a whole piece. In this embodiment, the locating device 205 comprises a magnet provided on the locating device 205 or on the guiding unit, and attraction force is formed between the locating device 205 and the guiding unit; the locating device 205 is not limited to the magnetic mode, and the mechanical or electrical locating mode in the prior art may also be adopted.

Preferably, the opening module 300 comprises two sets of drag hooks 301 operating alternately, which are adapted for opening the shoe cover 000. It should be understood that, the drag hooks 301 may also be more than two sets, but the configuration of two sets is most space saving. The opening module 300 further comprises two conveyor belts 302 rotating synchronously, two sets of drag hooks 301 are provided, which are both fixedly connected on the inside of the two conveyor belts 302, the first set and the second set of drag hooks are arranged evenly on the circumferential direction of the conveyor belts, the conveyor belt 302 in this embodiment is driven by a driving shaft and a driven wheel, and the configuration of positioned evenly on the circumferential direction of the conveyor belt refers to that the length of the conveyor belt between the two sets of drag hooks is half of the overall length of the conveyor belt 302; it should be understood that, as an alternative solution of the conveyor belts, the configuration of chain wheels/cycle chains may also be adopted to implement the present invention, and in this alternative solution, the opening module further comprises two cycle chains rotating synchronously, two sets of drag hooks are provided, which are both fixedly connected on the inside of the two cycle chains, the first set and the second set of drag hooks are arranged evenly on the circumferential direction of the cycle chains. In this embodiment, the drag hook 301 is provided with a U-shaped notch, and the width of the U-shaped notch is wider than the width of the claw 201, so as to allow the claw 301 to be able to pass through the U-shaped notch. It should be understood that, L-shaped drag hooks may be employed instead of U-shaped drag hooks to implement the present invention, wherein, one end of the L-shaped drag hook is able to pass by the inner side of the claw. The U-shape and L-shape mentioned in the present invention refer to the shape of the drag hook on the plane perpendicular to its moving direction, which can be the cross-sectional shape of the drag hook, the projection shape of the drag hook or the shape of the movement track of the drag hook (as the two ends of the U-shape may be set to be in different planes, the projection on the plane perpendicular to its moving direction of this type of distortional U-shape, or the cross-section of the plane perpendicular to its moving direction of the movement track of this type of distortional U-shape, is still U-shaped, therefore, this type of distortional U-shape in the present invention is also named U-shaped drag hook). In this embodiment, the drag hook is also provided with a hook portion 304 on the front end along its moving direction; as for the U-shaped drag hook, the hook portion is provided on one of the ends of the U-shaped drag hook which passes by the inner side of the claw; as for the L-shape, the hook portion is arranged on the end of the drag hook which passes by the inner side of the claw; the tip of the hook portion has circular arc transition, so as to facilitate the detaching of the shoe cover during usage.

Preferably, a pair of relay poles 401 of the relay module 400 are provided, which are arranged at the inner side of the claws 201 and deviate a distance along the direction of the drag hooks 301 opening the shoe cover; the relay poles have unfolded status and folded status. The relay poles 401 are connected to a swing structure, so as to achieve unfolding and folding. In this embodiment, the swing structure comprises a wallboard 405 and a pair of crank-rocker mechanisms provided on the wallboard 405, the crank 404 is pin connected on the wallboard 405, one end of a connecting rod 403 is pin connected to the crank 404, the other end of the connecting rod 403 is pin connected to one end of the rocker 402, the other end of the rocker 402 is pin connected on the wallboard 405, the relay pole 401 is fixedly connected with the rocker 402, by this means, the rotation of the crank 404 is able to drive the swing of the relay pole 401. Of course, a stretch structure of the prior art may also be used instead of the aforementioned swing structure to implement the present invention.

Preferably, the opening module 300 comprises a pair of frames 305, and sliding rails 303 are provided on the bottom of the frames 305. When not being used, the opening module 300 can be pushed back through the sliding rails 303 to under the bottom of the storage module 100 and the extracting module 200, so as to save the occupied space.

Preferably, the shoe covers 000 are arranged in flat state and in stacked manner in the shoe cover storage module; the elongating direction of the shoe cover is consistent with the elongating direction of the elongated opening 102.

The various preferred implementation ways of this embodiment may be applied alone, or may be combined to form one overall preferred implementation way.

Figure 21:
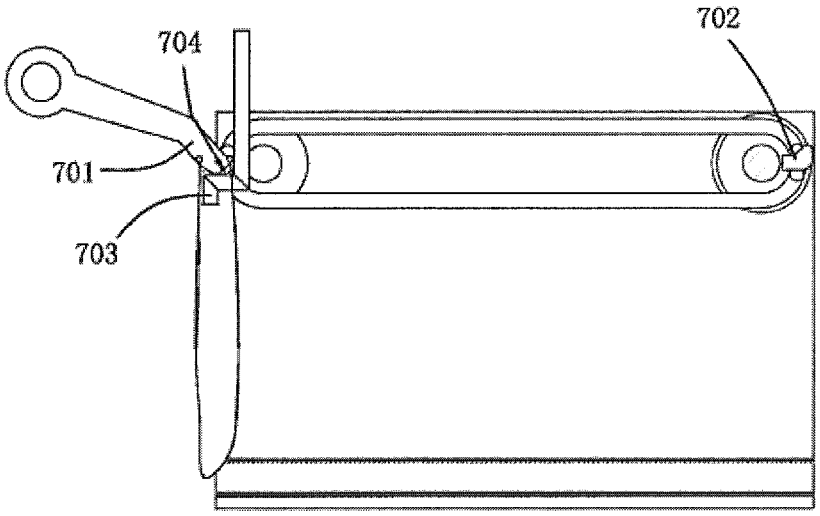
FIG. 21 is a side view of the relaying status of the seventh embodiment of the present invention.
Figure 22:
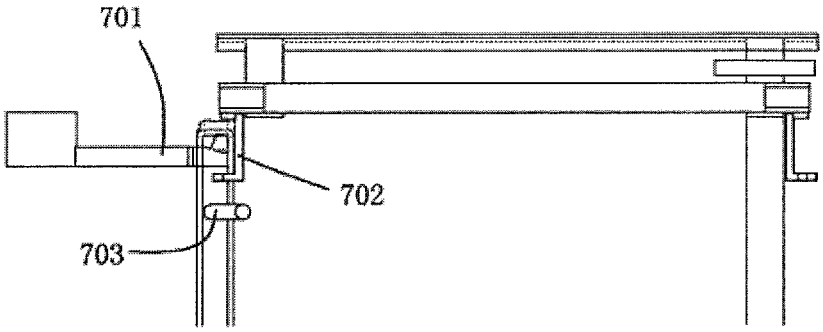
FIG. 22 is a vertical view of the relaying status of the seventh embodiment of the present invention.

Referring to FIGS. 21-22, a seventh embodiment of the present invention is a shoe cover dispensing system, comprising a shoe cover storage module, an extracting module, an opening module and a relay module, wherein, the storage module is provided with an elongated opening, an elastic mouth of each shoe cover is placed towards the elongated opening; the extracting module is provided with a pair of claws 701 which are able to be propped open and inverted; the opening module is provided with drag hooks 702 adapted for opening the shoe cover; the relay module is provided with relay poles 703 adapted for receiving the shoe cover from the claws. The shoe cover storage module is arranged on top of the extracting module, with the elongated opening oriented downwards, the opening module is arranged below the extracting module, with the shoe cover receiving end of the opening module arranged close to the extracting module, and the relay module is arranged close to the shoe cover receiving end of the opening module. In this embodiment, the extracting module comprises a reverse-flighted screw rod and a pair of nuts with screw-threads of inverse directions, a pair of the claws are fixedly connected on a pair of the nuts, respectively, or the claws are integrated with the nuts to form a whole piece respectively, and the extracting module further comprises a guiding unit adapted for constraining the rotation of the claws. The guiding unit comprises a locating frame provided with a locating slot along the elongating direction of the reverse-flighted screw rod, and the claws are constrained within the locating slot of the locating frame; it should be understood that, as an alternative solution of this embodiment, the means of locating may also be shaft locating, the locating shaft is provided along the elongating direction of the reverse-flighted screw rod, the claws have guiding apertures corresponding to the locating shaft, and the claws are sleeved onto the locating shaft through the guiding apertures. The locating frame in this embodiment is mostly the same with that in the sixth embodiment of the present invention, and what's different in this embodiment is that the guiding unit is connected to an inverting motor adapted for driving the guiding unit to invert around the axis of the reverse-flighted screw rod, so as to drive the claws to invert; the relay poles 703 are stationary. When the claw 701 is at the position of passing the shoe cover on to the relay pole, the claw 701 aligns with the relay pole 703 in the opening direction of the shoe cover. The relay pole is provided with a step structure 704 adapted for avoiding a collision with the claw. In this embodiment, the opening module comprises two sets of drag hooks 702 operating alternately, which are adapted for opening the shoe cover, and it should be understood that, more than two sets may also implement the present invention, it is not necessary to use more than two sets for occasion of parallel dragging, however, for occasion that requires tilted dragging (e.g. for shoe cover vending machine), three sets of drag hooks may be used, wherein, the conveyor belts or the cycle chains are propped open triangularly by three wheels, and in other embodiments of the present invention, the implementation ways of more than two sets of drag hooks are similar to the aforementioned way. In this embodiment, the opening module further comprises two conveyor belts rotating synchronously, two sets of drag hooks 702 are provided, which are both fixedly connected on the inside of the two conveyor belts, the first set and the second set of drag hooks are arranged evenly on the circumferential direction of the conveyor belts; or, the opening module further comprises two cycle chains rotating synchronously, two sets of drag hooks are provided, which are both fixedly connected on the inside of the two cycle chains, the first set and the second set of drag hooks are arranged evenly on the circumferential direction of the cycle chains. The drag hook 702 is provided with a U-shaped notch, and the width of the U-shaped notch is wider than the width of the claw, so as to allow the claw to be able to pass through the U-shaped notch; it should be understood that, as an alternative solution of this embodiment, L-shaped drag hooks may also implement the present invention, i.e. the drag hook is L-shaped, one end of the L-shaped drag hook is able to pass by the inner side of the claw. As for the modules not defined in this embodiment, the sixth embodiment of the present invention may be referenced.

Figure 23:
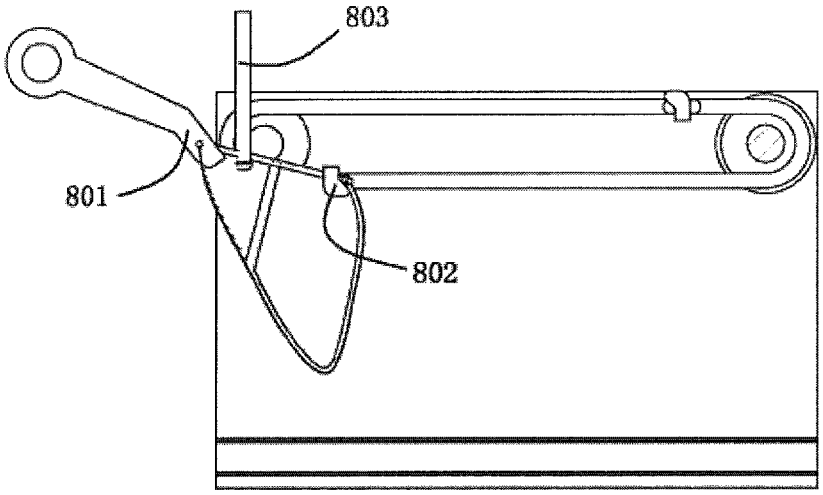
FIG. 23 is a side view of the relaying status of the eighth embodiment of the present invention.
Figure 24:
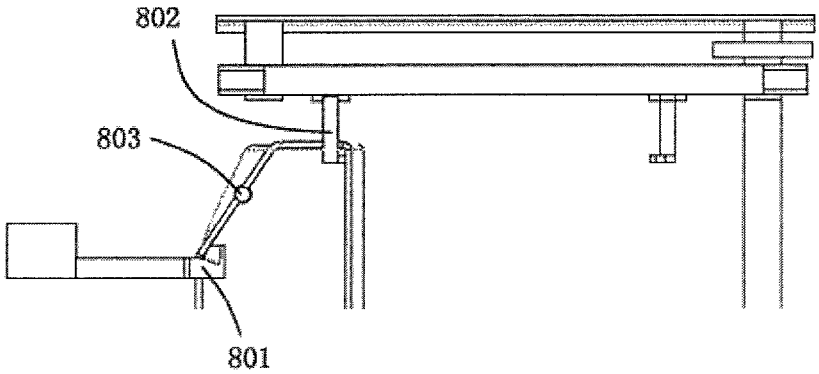
FIG. 24 is a vertical view of the relaying status of the eighth embodiment of the present invention.

Referring to FIGS. 23-24, an eighth embodiment of the present invention is a shoe cover dispensing system, comprising a shoe cover storage module, an extracting module, an opening module and a relay module, wherein, the storage module is provided with an elongated opening, an elastic mouth of each shoe cover is placed towards the elongated opening; the extracting module is provided with a pair of claws 801 which are able to be propped open and inverted; the opening module is provided with drag hooks 802 adapted for opening the shoe cover; the relay module is provided with relay poles 803 adapted for receiving the shoe cover from the claws. The shoe cover storage module is arranged on top of the extracting module, with the elongated opening oriented downwards, the opening module is arranged below the extracting module, with the shoe cover receiving end of the opening module arranged close to the extracting module, and the relay module is arranged close to the shoe cover receiving end of the opening module. In this embodiment, the extracting module comprises a reverse-flighted screw rod and a pair of nuts with screw-threads of inverse directions, a pair of the claws are fixedly connected on a pair of the nuts, respectively, or the claws are integrated with the nuts to form a whole piece respectively, and the extracting module further comprises a guiding unit adapted for constraining the rotation of the claws. The guiding unit comprises a locating frame provided with a locating slot along the elongating direction of the reverse-flighted screw rod, and the claws are constrained within the locating slot of the locating frame; it should be understood that, as an alternative solution of this embodiment, the means of locating may also be shaft locating, the locating shaft is provided along the elongating direction of the reverse-flighted screw rod, the claws have guiding apertures corresponding to the locating shaft, and the claws are sleeved onto the locating shaft through the guiding apertures. The locating frame in this embodiment is mostly the same with that in the sixth embodiment of the present invention, and the difference in this embodiment is that the guiding unit is connected to an inverting motor adapted for driving the guiding unit to invert around the axis of the reverse-flighted screw rod, so as to drive the claws to invert. In this embodiment, the relay poles 803 are stationary, the height of the bottom end of the relay pole 803 is lower than the height of the claw 801 at the relaying position, but higher than the height of the drag hook 802 when opening the elastic mouth. When the drag hook 802 begins to open the shoe cover, the position of the relay pole 803 is more forward than the position of the claw 801 in the opening direction of the shoe cover, and the bottom of the relay pole 803 is lower than the bottom of the claw 801; when the drag hook 802 has become in front of the relay pole in the opening direction of the shoe cover, the claw 801 begins to fold to the middle, so as to pass the shoe cover on to the relay pole 803. When the drag hook 802 is at the position of aligning with the relay pole 803 in the opening direction of the shoe cover, the drag hook 802 is below the bottom of the relay pole 803. The opening module comprises two (or more than two) sets of drag hooks 802 operating in circulation, which are adapted for opening the shoe cover. The opening module further comprises two conveyor belts rotating synchronously, two sets of drag hooks are provided, which are both fixedly connected on the inside of the two conveyor belts, the first set and the second set of drag hooks are arranged evenly on the circumferential direction of the conveyor belts; or, the opening module further comprises two cycle chains rotating synchronously, two sets of drag hooks are provided, which are both fixedly connected on the inside of the two cycle chains, the first set and the second set of drag hooks are arranged evenly on the circumferential direction of the cycle chains. The shoe cover dispensing system further comprises rear-end conveyor belt wheels or rear-end chain wheels, the drag hook begins to open the shoe cover at the horizontally rear end point of the rear-end conveyor belt wheel or the rear-end chain wheel, the horizontal projection of the relay pole 803 is within the area of the rear-end conveyor belt wheel or the rear-end chain wheel, so as to ensure that when the drag hook is at the position of aligning with the relay pole 803, the drag hook 802 is below the bottom of the relay pole 803. The drag hook 802 is provided with a U-shaped notch, and the width of the U-shaped notch is wider than the width of the claw 801, so as to allow the claw 801 to be able to pass through the U-shaped notch; it should be understood that, as an alternative solution of this embodiment, L-shaped drag hooks may also implement the present invention, i.e. the drag hook 802 is L-shaped, one end of the L-shaped drag hook 802 is able to pass by the inner side of the claw. As for the modules not defined in this embodiment, the sixth embodiment of the present invention may be referenced.

Figure 19:
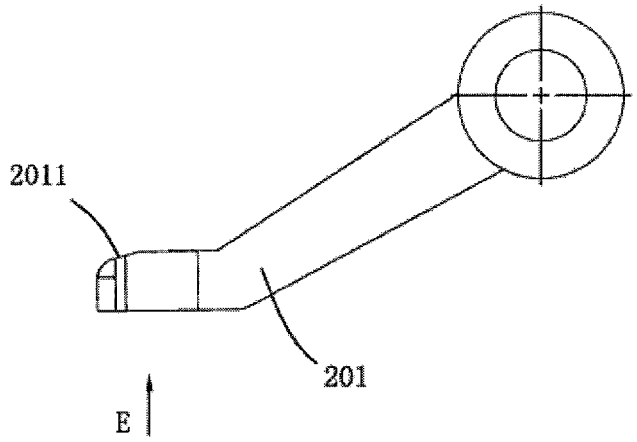
FIG. 19 is a view from direction D in FIG. 18.
Figure 20:
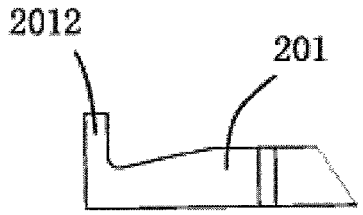
FIG. 20 is a view from direction E in FIG. 19.

A ninth embodiment of the present invention is also a shoe cover dispensing system, comprising an extracting module, wherein, the extracting module is provided with a pair of claws which are able to be propped open and inverted; referring to FIGS. 19-20 of the sixth embodiment of the present invention, the front end of each of the claws is provided with a hook portion 2012, two hook portions of a pair of the claws are arranged back to back; a chamfer 2011 for relaying is provided on the backside surface of the front end of each of the claws, of course, an arc for relaying can be used instead of the chamfer for relaying, the backside surface is opposite to the inverting direction of each of the claws. As for implementation of the modules or parts not defined in this embodiment, the sixth embodiment of the present invention may be referenced.

A tenth embodiment of the present invention is also a shoe cover dispensing system, comprising a shoe cover storage module, an extracting module and an opening module, wherein the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the shoe covers are arranged in flat state and in stacked manner in the shoe cover storage module; the elongating direction of the shoe cover is consistent with the elongating direction of the elongated opening, and the direction of the claws propping the shoe cover open is also consistent with the elongating direction of the elongated opening. In this embodiment, the shoe cover storage module is arranged on top of the extracting module, with the elongated opening oriented downwards, and the opening module is arranged below the extracting module, with the shoe cover receiving end of the opening module arranged close to the extracting module. The extracting module comprises a reverse-flighted screw rod and a pair of nuts with screw-threads of inverse directions, a pair of the claws are fixedly connected on a pair of the nuts, respectively, or the claws are integrated with the nuts to form a whole piece respectively; and the extracting module further comprises a guiding unit adapted for constraining the rotation of the claws, an oscillating arm, and a locating device adapted for fastening the guiding unit; the claws are constrained to slip along the guiding unit. The extracting module further comprises a decelerating mechanism through which the locating frame is connected in mechanical linkage with the screw rod; the oscillating arm is connected to the locating frame through a clutch mechanism; the clutch mechanism comprises an arc-shaped slot provided on the oscillating arm and a pin provided inside the arc-shaped slot, the pin is fixedly connected on the locating frame. As for implementation of other modules or parts not defined in this embodiment, the sixth embodiment of the present invention may be referenced, and what needs to be explained is that, this embodiment may also be implemented without providing the relay module as in the sixth embodiment, specifically, after the drag hooks start the opening, the claws hold still at the position of dragging open so as to await use, and the claws do not revert back until the usage has been completed, also, an effect achieved is that the requirements of accuracy for pre-storing the shoe covers are lowered as the claws rectilinearly prop the shoe cover open along the elongating direction of its elastic mouth, and another effect achieved is that the time of waiting for the drag hooks to return may be saved by using two or more sets of drag hooks in circulation.

An eleventh embodiment of the present invention is a shoe cover vending machine, which can achieve the effects of automatic and fast extraction and opening of the shoe covers, large amount storage of shoe covers, and reduced occupied space of the equipment. The shoe cover vending machine mainly comprises a storage system, an extracting device, an opening device, and a relay device.

The storage system mainly comprises shoe covers and a box, wherein the shoe covers are arranged in flat state and in stacked manner inside the box with the elastic mouth of each shoe cover placed downwards in round shape after being folded. An elongated slot is opened on the bottom of the box, with its elongating direction consistent with the elongating direction of the shoe cover after being folded. The box is at the upper part of the equipment.

The extracting device comprises a reverse-flighted screw rod, a pair of nuts, a pair of separating claws, a locating frame, an oscillating arm, a differential system, a pin, and a locator. At the initial state, the head of the separating claws is inserted into an elongated slot on the bottom of the box, and meanwhile insert into the shoe cover through the elastic mouth of the shoe cover. The separating claws are connected on the screw nuts, and generate movements of inverse directions of left and right driven by the rotation of the reverse-flighted screw rod, thus prop the elastic mouth of the shoe cover open. In order to control the rotation of the separating claws, the separating claws are constrained within the locating slot of the locating frame. After the separating claws have generated the required displacement, the locating frame begin to rotate, thus cause the separating claws to invert; the shoe cover hitched on the separating claws is brought to separate from inside the box through the elongated slot, and is delivered to the next working position. There are various ways for the locating frame to control the rotation of the separating claws. If the locating frame is designed into cylindrical shape, and its cylindrical surface is provided with spiral groove, then the rotation of the separating claws may also be achieved. In this embodiment, the locating frame is designed to rotate coaxially with the screw rod; the locating slot is designed into a rectilinear long slot, with its longitudinal direction consistent with the elongated slot on the bottom of the box. The rotation of the locating frame in this embodiment is designed to be in mechanical linkage with the screw rod. Through a small gear fixed on it, the screw rod drives a differential wheel and sequentially drives the oscillating arm to rotate; the oscillating arm acts on the locating frame, and the directional and quantitative rotation of the locating frame is achieved. Of course, using separate power system to act on the locating frame is also able to achieve the aforementioned motion. However, the way of using a mechanical linkage is more reliable. The purpose of providing the oscillating arm is to achieve asynchronous motions of the locating frame and the screw rod; because the rotation of the separating claws must not be started until a certain displacement has been generated for the shoe cover to hitch firmly on the separating claws. In this embodiment, an arc-shaped slot and a pin are provided on the oscillating arm and the locating frame, respectively (the two may switch position); when the pin moves within the arc-shaped slot, the locating frame has no motion power input and is at stationary state; after the pin moves to the end of the arc-shaped slot, the locating frame acquires the motion power of the oscillating arm and rotate with it. In order to avoid that the locating frame generates rotation because of other external forces (such as the friction force between the screw nuts and the screw rod) when the locating frame is at vacant slot position relative to the oscillating arm, a locator is provided on the machine body in this embodiment; a magnet or an iron piece is mounted on the locator; and an iron piece or a magnet is mounted on the corresponding position of the locating frame; the location of the locating frame is achieved through magnetic interaction. The extracting device take the shoe cover out from the storage box, and revert and deliver it to the initial point of the operation of the opening device, at this point, the elastic mouth of the shoe cover is placed upwards, and the longitudinal size that the elastic mouth is propped open is larger than the size in the subsequent opening direction of the shoe cover. The advantage of the design of this extracting device is that: by utilizing the reverse-flighted screw rod and nuts mechanism, the separating claws can be made to generate enough displacement, and in conjunction with the characteristics of the elastic mouth of the shoe cover, the shoe cover can be made to hitch firmly on the separating claws, so as to effectively avoid malfunction of the equipment. By utilizing the reverse-flighted screw rod and nuts mechanism, it is easier to achieve inversion of the separating claws, and the apparatus is simplified; by utilizing the slot and pin mechanism, asynchronous motions of the screw rod and the oscillating arm can be achieved, so that the numbers of control components is reduced, and the failure rate of the equipment is lowered; by utilizing of magnetic force to achieve locating, the accuracy requirement of control is lowered, so as to reduce cost and minimize failure rate.

The opening device mainly comprises two sets of wheels (including driving wheels and driven wheels, with at least two in each set), two belts, drag hooks fixed on the belts, a transmission shaft which transmits motion power so as to achieve synchronous operation of the two sets of wheel and belt mechanisms, a machine frame for fixation of the wheel and belt mechanisms, and guiding rails fixed on the machine frame. In this embodiment, chain wheel and cycle chain mechanisms are utilized (other mechanisms such as synchronous wheel and belt etc. may also achieve the purpose here), wherein, the transmission shaft transmits motion power from a motor to enable two driving chain wheels to rotate synchronously, thus drive the drag hooks fixed on the cycle chains to generate a circumferential-rectilinear-circumferential track of operating in circulation. The drag hooks are inserted into the elastic mouth of the shoe cover while moving in circumferential track, and then hook one edge of the elastic mouth of the shoe cover while moving rectilinearly to pull the shoe cover open. In order to improve the efficiency of the opening device, at least two drag hooks are provided on each cycle chain, and the positioning points of the drag hooks evenly divide the perimeter of the cycle chain; so that, when one drag hook is at the end point of operation, the other drag hook is at the initial point of operation in the meantime. In order to reduce the track area of movement of the drag hooks (lower the height of the apparatus), the drag hooks are fixed on the inside of the cycle chain. In order to facilitate the joint with the separating claws, the drag hook is designed into U-shaped. The width of the U-shaped notch is wider than the thickness of the separating claw; the bottom of the U-shape is near the center of the chain wheel. In order to facilitate the opening device retracting back into the inside of the apparatus when the apparatus is at stand-by state, so as to effectively save the occupied space, the transmission shaft is placed at the side of the end point of operation of the drag hooks, and guiding rail sets are provided on the machine frame used for mounting the opening device.

The relay device comprises a pair of relay poles, a pair of connecting rods, and a pair of cranks, characterized on that the relay pole is a movable part. In this embodiment, crank-rocker mechanisms are utilized to drive the relay poles to swing (unfold or fold), so as to achieve up and down displacement; of course, other mechanisms such as cam, sliding block etc. may also achieve the purpose here. By utilizing crank-rocker mechanisms, the mechanical wear is small, and the working life is greatly increased. The purpose of providing the relay poles is that, after the opening device begins to operate, the relay poles can take the place of the separating claws to hold the other side of the elastic mouth of the shoe cover in operation; so that, the separating claws are able to perform the extraction of another shoe cover in the meantime of this shoe cover being opened, so as to greatly increase the operation speed of the apparatus. The movable design of the relay poles is for avoiding a collision with the moving track of the elastic mouth of the shoe cover being pulled open by the drag hooks or the moving track of the separating claws inverting back. The position of the relay pole is designed to be more forward relative to the separating claw along the moving direction of the drag hook. When the drag hooks move to the upstream side of the relay poles, the relay poles are folded (to avoid the moving track of the elastic mouth of the shoe cover); when the drag hooks have pulled the elastic mouth of the shoe cover past the position corresponding to the relay poles, the relay poles unfold and insert into the opened shoe cover; so that, the separating claws are able to invert back and start the next extraction motion. The way of the shoe cover detaching from the separating claws is that, with the slot and pin design between the oscillating arm and the locating frame, the track of the separating claws when inverting back is also rectilinear first and then becomes spiral. In order to facilitate the detaching of the shoe cover from the separating claws, the working head of the separating claw has a protrusion designed on the side of the propping open direction of the shoe cover, the purpose of which is for the reliability of the extraction motion; on the same side, a recess is designed on the lower side of the protrusion, the purpose of which is that the elastic mouth of the shoe cover has a fixed position at the Y direction, so as to facilitate the joint of the drag hook; a chamfer is provided on the head of a backside surface at the moving direction of each of the drag hooks, the effect of which is that, when the separating claws retract along the X direction and the protrusion takes no effect, the pulling force acts on the chamfer after the elastic mouth of the shoe cover is pulled open by the drag hooks, so that the elastic mouth of the shoe cover slips off from the separating claws smoothly.

The invention claimed is:

1. A shoe cover dispensing method, comprising a shoe cover storage module, an extracting module, an opening module and a relay module, wherein, the method comprises the following steps:

S1: propping a shoe cover open;

S2: inverting;

S3: determining if relay has been reset, and if not then repeating step S3;

S4: opening;

S5: relaying;

S6: waiting for use;

S7: completing usage;

S8: resetting the relay;

S9: determining if the inverting has been completed, and if not then repeating step S9;

S10: jumping to step S4, wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; and the relay module is provided with relay poles adapted for receiving the shoe cover from the claws;

propping of step S1 refers to propping the elastic mouth of each shoe cover open inside the elongated opening by the claws of the extracting module;

inverting of step S2 refers to extracting the shoe cover out of the storage module by the claws of the extracting module through inverting motion;

determining of step S3 refers to determining if the relay has been reset, and if the relay has not been reset, then repeating step S3, and if the relay has been reset then jumping to the next step;

opening of step S4 refers to hooking the elastic mouth of the shoe cover by the drag hooks of the opening module and moving the drag hooks relative to the claws, thus opening the elastic mouth of the shoe cover;

relaying of step S5 refers to unfolding the relay poles of the relay module and receiving the shoe cover from the claws by the relay poles, thus allowing the relay poles to keep the elastic mouth of the shoe cover in propped state instead of the claws in conjunction with the drag hooks, when the claws are inverted back to the elongated opening and the next step S1 of propping are started;

resetting the relay of step S8 refers to folding the relay poles to a status the same as that before the relaying step;

determining of step S9 refers to determining if the inverting has been completed, and if it has not been completed then repeating step S9, and if the inverting has been completed then jumping to step S4 so as to enter the next loop.

2. The method of claim 1, wherein, the elongating direction of the shoe cover is consistent with the elongating direction of the elongated opening, movement of the claws for propping the elastic mouth open is a rectilinear motion in the elongating direction of the elongated opening, and the rectilinear motion is achieved by a reverse-flighted screw rod and a pair of nuts with screw-threads of inverse directions;

a pair of the claws are fixedly connected on a pair of the nuts, respectively, or the claws are integrated with the nuts to form a whole piece respectively.

3. The method of claim 1, wherein, the drag hook is provided with a U-shaped notch, and at the beginning of the opening step, two ends of the notch of the drag hook pass by two sides of the claw when the elastic mouth of the shoe cover is hooked by one end of the notch of the drag hook; or the drag hook is L-shaped, and at the beginning of the opening step, one end of the L-shaped drag hook passes by an inner side of the claw and hooks the elastic mouth of the shoe cover.

4. The method of claim 3, wherein, two sets of drag hooks are provided and adapted for operating alternately;

when one set of drag hooks complete the opening step, the other set of drag hooks are reset and prepared for receiving the next shoe cover, so as to save the time for returning the drag hooks.

5. A shoe cover dispensing method, comprising a shoe cover storage module, an extracting module, an opening module and a relay module, wherein, the method comprises the following steps:

S1: propping a shoe cover open;

S2: inverting;

S3: determining if the usage has been completed, and if not then repeating step S3;

S4: opening;

S5: resetting the relay;

S6: relaying;

S7: waiting for use;

S8: completing usage;

S9: determining if the inverting has been completed, and if not then repeating step S9;

S10: jumping to step S4, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws;

propping of step S1 refers to propping the elastic mouth of each shoe cover open inside the elongated opening by the claws of the extracting module;

inverting of step S2 refers to extracting the shoe cover out of the storage module by the claws of the extracting module through inverting motion;

determining of step S3 refers to determining if the usage has been completed, and if not then repeating step S3, and if the usage has been completed then jumping to the next step;

opening of step S4 refers to hooking the elastic mouth of the shoe cover by the drag hooks of the opening module and moving the drag hooks relative to the claws, thus opening the elastic mouth of the shoe cover;

resetting the relay of step S5 refers to folding the relay poles before the drag hooks pass a relaying position at which the unfolded relay poles stay;

relaying of step S6 refers to unfolding the relay poles of the relay module and receiving the shoe cover from the claws by the relay poles, thus allowing the relay poles to keep the elastic mouth of the shoe cover in propped state instead of the claws in conjunction with the drag hooks, when the claws are inverted back to the elongated opening and the next step S1 of propping are started;

determining of step S9 refers to determining if the inverting has been completed, and if it has not been completed then repeating step S9, and if the inverting has been completed then jumping to step S4 so as to enter the next loop.

6. The method of claim 5, wherein, the elongating direction of the shoe cover is consistent with the elongating direction of the elongated opening, and movement of the claws for propping the elastic mouth open is a rectilinear motion in the elongating direction of the elongated opening;

the rectilinear motion is achieved by a reverse-flighted screw rod and a pair of nuts with screw-threads of inverse directions, a pair of the claws are fixedly connected on a pair of the nuts, respectively, or the claws are integrated with the nuts to form a whole piece respectively;

the drag hook is provided with a U-shaped notch, and at the beginning of the opening step, two ends of the notch of the drag hook pass by two sides of the claw when the elastic mouth of the shoe cover is hooked by one end of the notch of the drag hook; or the drag hook is L-shaped, and at the beginning of the opening step, one end of the L-shaped drag hook passes by an inner side of the claw and hooks the elastic mouth of the shoe cover;

two sets of drag hooks are provided and adapted for operating alternately, when one set of drag hooks complete the opening step, the other set of drag hooks are reset and prepared for receiving the next shoe cover, so as to save the time for returning the drag hooks;

a pair of the relay poles with free ends are provided, during the relaying step the free ends of the relay poles swing downward or extend downward, and during the relay resetting step the free ends of the relay poles swing upward or retract upward;

a chamfer for relaying is provided on a backside of each of the claws;

the shoe covers are arranged in flat state and in stacked manner in the shoe cover storage module;

the shoe cover is opened in width direction thereof.

7. A shoe cover dispensing method, comprising a shoe cover storage module, an extracting module, an opening module and a relay module, wherein, the method comprises the following steps:

S1: propping a shoe cover open;

S2: determining if the usage has been completed, and if not then repeating step S2;

S3: inverting;

S4: opening;

S5: relaying;

S6: waiting for use;

S7: completing usage;

S8: determining if the inverting has been completed, and if not then repeating step S8;

S9: jumping to step S4, wherein, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; the position of the claw at step S5 aligns with the relay pole in the opening direction of the shoe cover;

propping of step S1 refers to propping the elastic mouth of each shoe cover open inside the elongated opening by the claws of the extracting module;

inverting of step S3 refers to delivering the shoe cover to a relay position by the claws of the extracting module through inverting motion, and allowing the elastic mouth of the shoe cover to encompass the relay poles;

opening of step S4 refers to hooking the elastic mouth of the shoe cover by the drag hooks of the opening module and moving the drag hooks relative to the claws, thus opening the elastic mouth of the shoe cover;

relaying of step S5 refers to acting a dragging force on the elastic mouth of the shoe cover by the drag hooks, allowing the elastic mouth of the shoe cover to detach from the claws and slip to the relay poles, thus allowing the relay poles to keep the elastic mouth of the shoe cover in propped state instead of the claws in conjunction with the drag hooks, when the claws are inverted back to the elongated opening and the next step S1 of propping are started;

determining of S8 refers to determining if the inverting has been completed, and if it has not been completed then repeating step S8, and if the inverting has been completed then jumping to step S4 so as to enter the next loop.

8. The method of claim 7, wherein, during the relaying step S5, the dragging force of the drag hooks is acted on the elastic mouth of the shoe cover, and meanwhile the claws move towards the middle, so as to cause the elastic mouth of the shoe cover to detach from the claws and slip to the relay poles.

9. The method of claim 7, wherein, the relay poles are able to be unfolded and folded.

10. The method of claim 7, wherein, the relay poles are set stationary, and each relay pole is provided with a step structure adapted for avoiding a collision with the claw.

11. A shoe cover dispensing method, characterized in that, with a shoe cover storage module, an extracting module, an opening module and a relay module, the method comprises the following steps:

S1: propping a shoe cover open;

S2: inverting;

S3: determining if the usage has been completed, and if not then repeating step S3;

S4: opening;

S5: relaying;

S6: waiting for use;

S7: completing usage;

S8: determining if the inverting has been completed, and if not then repeating step S8;

S9: jumping to step S4, the storage module is provided with an elongated opening, an elastic mouth of each shoe cover is placed towards the elongated opening; the extracting module is provided with a pair of claws which are able to be propped open and inverted; the opening module is provided with drag hooks adapted for opening the shoe cover; the relay module is provided with relay poles adapted for receiving the shoe cover from the claws; the relay poles are set stationary, and in the opening direction of the shoe cover, the position of the relay pole is more forward than the position of the claw at step S5, and the drag hooks pass by below the bottom of the relay poles when performing step S4;

propping of step S1 refers to propping the elastic mouth of each shoe cover open inside the elongated opening by the claws of the extracting module;

inverting of step S2 refers to extracting the shoe cover out of the storage module by the claws of the extracting module through inverting motion;

opening of step S4 refers to hooking the elastic mouth of the shoe cover by the drag hooks of the opening module and moving the drag hooks relative to the claws, thus opening the elastic mouth of the shoe cover;

relaying of step S5 refers to hanging the shoe cover onto the relay poles of the relay module by the claws and then inverting the claws back, thus allowing the relay poles to keep the elastic mouth of the shoe cover in propped state instead of the claws in conjunction with the drag hooks, and the next step S1 of propping are started when the claws are inverted back to the elongated opening;

determining of step S8 refers to determining if the inverting has been completed, and if it has not been completed then repeating step S8, and if the inverting has been completed then jumping to step S4 so as to enter the next loop.

12. The method of claim 11, wherein, relaying of step S5 is performed after the drag hooks pass by below the bottom of the relay poles in the opening step S4.

13. The method of claim 12, wherein, relaying of step S5 is started before the completion of step S4, and step S6 is performed after the completion of both step S4 and step S5.

14. A shoe cover dispensing system, comprising a shoe cover storage module, an extracting module, an opening module and a relay module, wherein, the storage module is provided with an elongated opening, an elastic mouth of each shoe cover is placed towards the elongated opening;

the extracting module is provided with a pair of claws which are able to be propped open and inverted; the opening module is provided with drag hooks adapted for opening the shoe cover;

the relay module is provided with relay poles adapted for receiving the shoe cover from the claws, thus allowing the relay poles to keep the elastic mouth of the shoe cover in propped state instead of the claws in conjunction with the drag hooks while the claws are inverted back to the elongated opening to prop the next shoe cover open;

the shoe cover storage module is arranged on top of the extracting module, with the elongated opening oriented downwards;

the opening module is arranged below the extracting module, with the shoe cover receiving end of the opening module arranged close to the extracting module;

the relay module is arranged close to the shoe cover receiving end of the opening module;

the extracting module comprises a reverse-flighted screw rod and a pair of nuts with screw-threads of inverse directions;

a pair of the claws are fixedly connected on a pair of the nuts, respectively, or the claws are integrated with the nuts to form a whole piece respectively;

the extracting module further comprises a guiding unit adapted for constraining the rotation of the claws;

the guiding unit comprises a locating frame provided with a locating slot along the elongating direction of the reverse-flighted screw rod, and the claws are constrained within the locating slot of the locating frame; or the guiding unit comprises a locating shaft provided along the elongating direction of the reverse-flighted screw rod, the claws have guiding apertures corresponding to the locating shaft, and the claws are sleeved onto the locating shaft through the guiding apertures.

15. The system of claim 14, wherein, the extracting module further comprises an oscillating arm connected to the guiding unit, and a decelerating mechanism through which the guiding unit is connected in mechanical linkage with the screw rod.

16. The system of claim 15, wherein:

the oscillating arm is connected to the guiding unit through a clutch mechanism.

17. The system of claim 15, wherein, the decelerating mechanism is a gear mechanism comprising an input gear fixed on the reverse-flighted screw rod, a dual gear engaged with the input gear, an output gear engaged with the dual gear, and an oscillating arm fixedly connected on the output gear; or the decelerating mechanism is a synchronous belt decelerating mechanism.

18. The system of claim 16, wherein, the clutch mechanism comprises an arc-shaped slot provided on the oscillating arm and a pin provided inside the arc-shaped slot, the pin is fixedly connected on the locating frame; or the clutch mechanism comprises an arc-shaped slot provided on the locating frame and a pin provided inside the arc-shaped slot, the pin is fixedly connected on the oscillating arm.

19. The system of claim 14, wherein, the opening module comprises two or more sets of drag hooks operating in circulation, which are adapted for opening the shoe cover, the opening module further comprises two conveyor belts rotating synchronously; two sets of drag hooks are provided, which are both fixedly connected on the inside of the two conveyor belts, the first set and the second set of drag hooks are arranged evenly on the circumferential direction of the conveyor belts; or the opening module further comprises two cycle chains rotating synchronously; two sets of drag hooks are provided, which are both fixedly connected on the inside of the two cycle chains, the first set and the second set of drag hooks are arranged evenly on the circumferential direction of the cycle chains.

* * * * *